US011931644B2

(12) United States Patent
Hughes

(10) Patent No.: US 11,931,644 B2
(45) Date of Patent: Mar. 19, 2024

(54) SKI CARRIER APPARATUS

(71) Applicant: Richard D. Hughes, Centennial, CO (US)

(72) Inventor: Richard D. Hughes, Centennial, CO (US)

( * ) Notice: Subject to any disclaimer, the term of this patent is extended or adjusted under 35 U.S.C. 154(b) by 206 days.

(21) Appl. No.: 17/680,314

(22) Filed: Feb. 25, 2022

(65) Prior Publication Data

US 2022/0323849 A1 Oct. 13, 2022

Related U.S. Application Data

(60) Provisional application No. 63/172,105, filed on Apr. 8, 2021.

(51) Int. Cl.
*A63C 11/02* (2006.01)

(52) U.S. Cl.
CPC ..... *A63C 11/025* (2013.01); *A63C 11/021* (2013.01)

(58) Field of Classification Search
CPC . A63C 11/025; A63C 11/021; Y10S 224/917; A45F 2003/142; A45F 3/14; A45F 2200/05; A45F 2003/003; A41D 13/0012; A41D 13/0007; A41D 2400/48
USPC ..... 224/575–576, 917
See application file for complete search history.

(56) References Cited

U.S. PATENT DOCUMENTS

| | | | | |
|---|---|---|---|---|
| 5,190,336 | A * | 3/1993 | Palz | A63C 11/02 294/149 |
| 5,853,212 | A * | 12/1998 | Daniel | A63C 11/025 294/147 |
| 8,806,723 | B2 * | 8/2014 | Martinson | B65D 63/00 24/3.12 |
| 9,392,860 | B2 * | 7/2016 | Redli | A41D 3/00 |
| 9,656,152 | B2 * | 5/2017 | Steele | A45F 3/14 |
| 2012/0292362 | A1 * | 11/2012 | Dee | A45F 3/14 224/576 |

* cited by examiner

*Primary Examiner* — Adam J Waggenspack
(74) *Attorney, Agent, or Firm* — Roger A. Jackson

(57) ABSTRACT

A ski carrier apparatus for manually carrying skis, the ski carrier apparatus includes a flexible bracket to hold skis together in the form of a "C" shaped channel including a planar base portion having a first end portion and an opposing second end portion, a first leg and a second leg that each extend in a same direction and parallel to one another, the first and second legs each terminate in a respective first and second hook sections. The ski carrier apparatus further includes a strap having a first strap end and a second strap end that are removably engageable to a cord, wherein the strap is looped around an upper torso of a user and the cord looped around a ski toe binding assembly to suspend the skis above the ground allowing the user to carry the skis via walking in a handsfree manner.

14 Claims, 25 Drawing Sheets

SKI CARRIER APPARATUS

RELATED APPLICATION

This application claims the benefit of United States provisional patent application Ser. No. 63/172,105 filed on Apr. 8, 2021 by Richard D. Hughes of Centennial, CO, U.S.

FIELD OF THE INVENTION

The present invention generally relates to the manual carrying of elongated articles. More particularly, the present invention is used with articles that are typically skis or a snowboard that allows for "hands free" carrying of the skis or snowboard from the parking lot or transportation terminal to the ski lift or ski lodge.

DESCRIPTION OF THE RELATED ART

Usually at a ski resort the skier has to carry their skis and poles which are inconvenient, bulky, unwieldy, and somewhat heavy, if the skis are carried horizontally then the weight can be put on the skier's shoulder but the skis can slip off of the shoulder and this can be dangerous is crowded situations where the ski tips could hit someone, also if the skis are carried vertically which would be safer in a crowded situation then the weight of the skis really becomes burdensome, so basically the manual carrying of skis is a hassle, or being a lot of the same issues with a snowboard also. A further complication is that the surface (usually an open parking lot) is typically somewhat slick ice and packed snow which can be tricky to walk on while carrying skies or snowboard especially when walking in ski boots or snowboard boots.

Looking at the prior art in U.S. Pat. No. 4,015,762 to Mendillo disclosed is a portable ski carrier having a strap with an "S" hook and loop end for encompassing the skis wherein the strap in carried by the hand or over the shoulder.

Further, in U.S. Pat. No. 5,190,336 to Palz disclosed is a pocket carrier for skis and poles that has a pair of looped ends that had a slidable spring loaded retainer to cinch down on the loop to keep it tightly secured around the skis, wherein the skier uses their poles as a handle secured by the other end of the loop.

Continuing, U.S. Pat. No. 5,335,835 to Hogan disclosed is a ski equipment carrying strap having Velcro rings and a hook clip at each end, wherein the Velcro rings wrapped around the skis and poles with the hooks attaching to the boots.

Next, U.S. Pat. No. 5,450,991 to Neading. disclosed is a storage belt and ski carrier using Fastex buckles and Velcro sections to form a one-sided shoulder strap wherein the Velcro section wraps around the skis to hold them together and the buckles secures the belt over the shoulder.

Moving onward, U.S. Pat. No. 6,457,762 to Garutti disclosed is a ski carrying device rope/cable having three loops, one at each end and one in the middle using the one end loop and middle loop to wrap around the ski ends, wherein the user grabs the remaining loop pulling the device over their shoulder.

Further, U.S. Pat. No. 8,905,275 to Klein disclosed is a ski carrying device strap having Velcro loops and length adjusting retainers wherein the Velcro loops wrap around the ski ends with the straps used as a backpack with shoulder straps.

Continuing, United States Patent Application Publication Number 2004/0200869 to Toleman disclosed is a carrying device having strap with a ring on one end that loops over the toe binding of the ski with the remainder of the strap placed over the shoulder with the skis suspended vertically.

Further, United States Patent Application Publication Number 2016/0101344 to Steele disclosed is a sling carrier for skis in the form of a strap with a end pocket and ratchet strap sections that go around the skis with the end pocket holding the bottom of the skis, wherein the strap slings over the user's shoulder.

This helps to give the current state of the art in the manual ski carrier arts based on the above cited references, as there are many versions of retaining skis to a user's body. Ideally a manual ski carrier apparatus would include the following features;

a. Hands free operation-requiring the manual ski carrier apparatus to be self-supporting and self-balancing for the skis and snowboard against the user's body.
b. Can be used with ski attire on the user, i.e. used with ski jacket, gloves, ski pants, ski boots, ski helmet, goggles, and the like.
c. Must be small and light weight, plus easy to store for instance in a jacket pocket when not in use.
d. Quick and easy to deploy and store, preferably while wearing gloves.
e. Be easily adjustable for different sizes of skis and snowboards.
f. Be water-proof, good for cold weather, and not damage the skis or snowboard.

SUMMARY OF INVENTION

Broadly, the present invention is a ski carrier apparatus for manually carrying skis, the ski carrier apparatus includes a flexible bracket in the form of a "C" shaped channel including a planar base portion having a first end portion and an opposing second end portion with a base longitudinal axis spanning therebetween, a first leg and a second leg that each extend in a same direction and parallel to one another respectively from the first and second end portions, the first and second legs each terminate in a respective first and second hook sections that each face inward towards one another. Wherein the flexible bracket is constructed of an elastic band that extends through said first hook section, continuing to the first leg, next to the planar base portion, further to the second leg, and to said second hook section, the elastic band is folded back unto itself to form a double layer comprising a primary layer and a secondary layer, wherein the secondary layer terminates at a first margin and a second margin, such that the first and second margins are spaced apart along the longitudinal axis forming a gap Also the flexible bracket is constructed of a first semi rigid bendable "U" shaped planar section that is disposed between the first hook section and the first margin and further disposed between the primary and secondary layers, wherein operationally the first semi rigid bendable "U" shaped planar section adds a selectable shape that is manually formed between the first hook section and the first margin to set a first length of said first leg and corresponding the first hook section to accommodate different size skis. In addition, the flexible bracket includes a second semi rigid bendable "U" shaped planar section that is disposed between the second hook section and the second margin and further disposed between the primary and secondary layers, wherein operationally the second semi rigid bendable "U" shaped planar section adds a selectable shape that is manually formed between the second hook section and the second margin to set a second length of the second leg and corresponding the second hook section to accommodate different size skis in ski width and thickness, wherein operationally after the first and second legs and the first and second hook section and then using the elastic band on a portion disposed between the first and second margins to stretch with a closing bias between the first and second legs and the first and second hook sections to fit over and secure to edges of the skis to ultimately hold the skis together with ski bases in contact with one another.

The ski carrier apparatus further includes an adjustable strap having a first strap end and an opposing second strap end, wherein operationally the strap is looped around an upper torso of a user and a cord having a first cord end with a first means for removable engagement to the adjustable strap first strap end and an opposing second cord end with a second means for removable engagement to the adjustable strap second strap end, wherein operationally the cord is adjacent to a lower torso of the user with the cord looped around a ski toe binding assembly to suspend the skis above the ground allowing the user to carry the skis via walking in a hands free manner.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 12 shows a side elevation view that is opposing to the view shown in FIG. 11, wherein FIG. 12 shows the ski jacket opened to show the outer surface of the torso surrounding sidewall with the right hand front zipper margin to expose the cord external on the jacket and its first and second apertures that are disposed therethrough the ski jacket torso surrounding sidewall;

FIG. 17 is section cut 17-17 from FIG. 15, wherein FIG. 17 shows the cross section of the elastic band of the flexible bracket to accommodate different width skis;

FIG. 18 is section cut 18-18 from FIG. 15, wherein FIG. 18 shows the cross section of the "U" shaped planar section that is multi layered and is rigid and bendable with the elastic band as a covering of the flexible bracket to accommodate different thickness skis;

FIG. 21 shows a perspective view of the of the flexible bracket on the first and second "U" bendable shaped planar sections side being an opposing view to what is shown in FIG. 20, wherein FIG. 21 shows the first and second "U" bendable shaped planar sections clamping the pair of skis together accommodating both different ski thicknesses via the first and second "U" bendable shaped planar sections and different ski widths via the elastic band;

FIG. 23 shows an opposing view to FIG. 22, wherein FIG. 23 shows the slot disposed therethrough the torso surrounding sidewall for the cord to pass through the ski jacket torso surrounding sidewall as viewed from the inner surface of the torso surrounding sidewall, also shown is the fold over/under hook and loop fastener to close the slot around the cord or to close the torso surrounding sidewall when the cord is not in use, i.e. not going therethrough the slot, wherein the fold over/under hook and loop fastener is disposed on the outer surface of the torso surrounding sidewall of the ski jacket;

FIG. 25 shows an opposing view to FIG. 24, wherein FIG. 25 shows the slot disposed therethrough the torso surrounding sidewall for the cord to pass through the ski jacket torso surrounding sidewall as viewed from the inner surface of the torso surrounding sidewall, also shown is the upper/lower zipper teeth with slider fastener to close the slot around the cord or to close the torso surrounding sidewall when the cord is not in use, i.e. not going therethrough the slot, wherein the upper/lower zipper teeth with slider fastener is disposed on the outer surface of the torso surrounding sidewall of the ski jacket.

REFERENCE NUMBERS IN DRAWINGS

Figure 1:
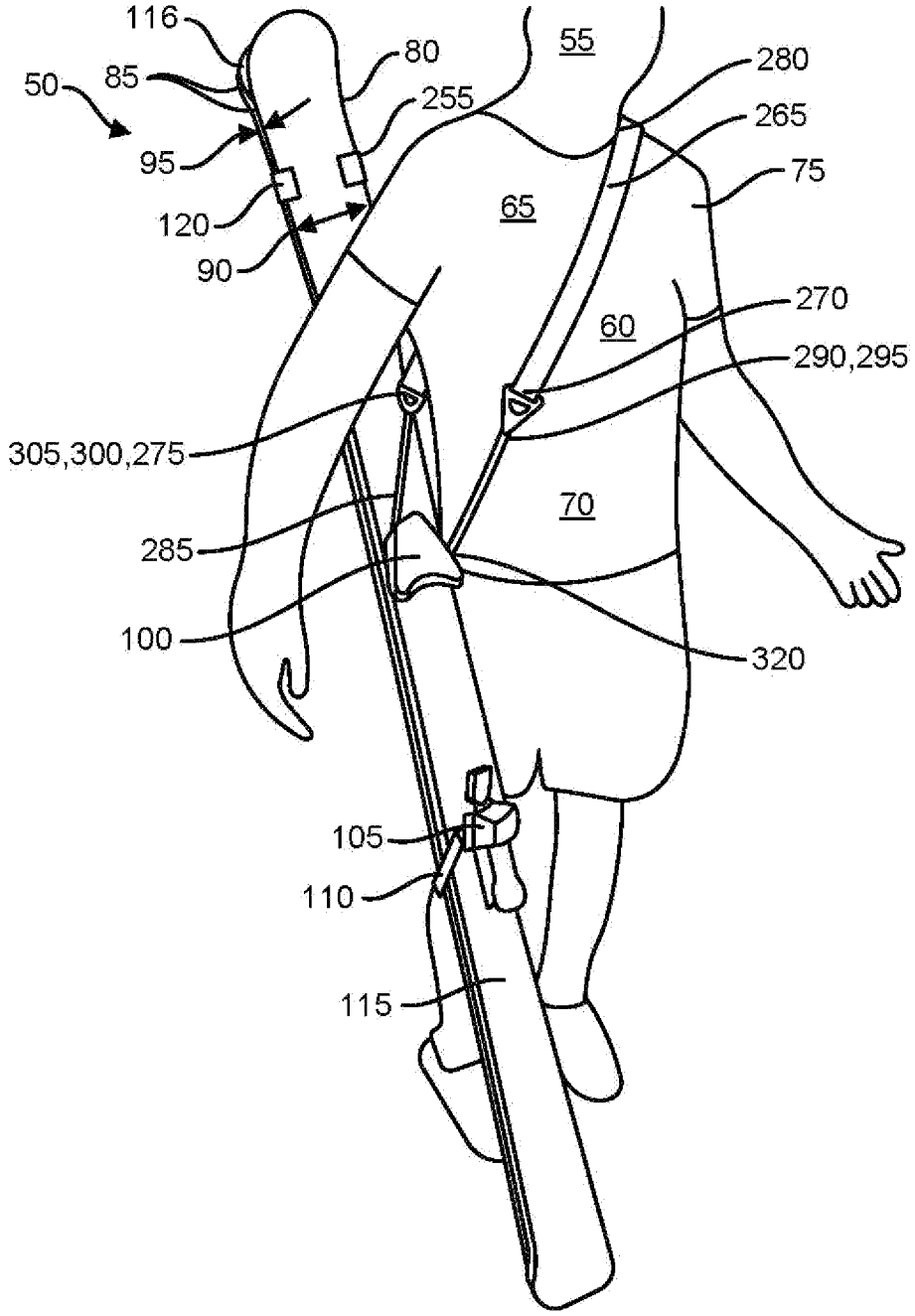
FIG. 1 shows an upper perspective use view of the ski carrier apparatus that includes the flexible bracket holding the skis together, the adjustable strap looped over the user's shoulder, the first and second means for removable engagement, the cord looped around the toe binding of the ski, and the skis.

50 Ski/snowboard carrier apparatus
55 User
60 Torso of the user 55
65 Upper torso of the user 55
70 Lower torso of the user 55
75 Left upper arm of the user 55
76 Right upper arm of the user 55
80 Skis
81 Snowboard
85 Edges of the skis 80
90 Width of the skis 80
95 Thickness of the skis 80
100 Toe binding of the ski 80
101 Front foot binding of the snowboard 81
105 Heel binding of the ski 80 including retractable brakes 110 that partially hold the tail portion
115 of the skis 80 together
106 Rear foot binding of the snowboard 81
110 Retractable brakes of the skis 80
115 Tail portion of the skis 80
116 Bases of the skis 80
120 Flexible bracket
125 "C" shaped channel of the flexible bracket 120
130 Planar base portion of the flexible bracket 120
135 First end portion of the flexible bracket 120
140 Second end portion of the flexible bracket 120
145 Base longitudinal axis of the flexible bracket 120
150 First leg of the flexible bracket 120
155 Second leg of the flexible bracket 120
160 First hook section of the flexible bracket 120
165 Second hook section of the flexible bracket 120
170 Face inward of the first 160 and second 165 hook sections
175 Elastic band of the flexible bracket 120
180 Folded back unto itself of the elastic band 175
185 Double layer of the elastic band 175
190 Primary layer of the elastic band 175
195 Secondary layer of the elastic band 175
200 First margin of the elastic band 175
205 Second margin of the elastic band 175
210 Gap between the first 200 and second 205 margins
215 First semi rigid bendable "U" shaped planar section
220 First length of the first leg 150
225 Corresponding first hook section
230 Second semi rigid bendable "U" shaped planar section
235 Second length of the second leg 155
240 Corresponding second hook section 165
245 Stretch of the elastic band 175
250 Closing bias of the elastic band 175
255 Holding the skis 80 together
260 Ski bases 116 in contact with one another
265 Adjustable strap
270 First strap end of the adjustable strap 265
275 Second strap end of the adjustable strap 265
280 Looping the adjustable strap 265 around the upper torso 65 of the user 55
285 Cord
290 First end of the cord 285
295 First means for removable engagement
300 Second end of the cord 285
305 Second means for removable engagement
310 Primary portion of the cord 285
315 Secondary portion of the cord 285

320 Cord 285 looped around the toe binding 100 of the ski 80 or cord 285 looped around the front foot binding 101 of the snowboard 81
325 Ski or snowboard jacket
326 Rear collar tag of the jacket 325
330 Torso surrounding sidewall of the jacket 325
335 Inner surface of the torso surrounding sidewall 330
340 Outer surface of the torso surrounding sidewall 330
345 Right hand front zipper of the torso surrounding sidewall 330
350 Left hand front zipper of the torso surrounding sidewall 330
355 Right back of the torso surrounding sidewall 330
360 Left back of the torso surrounding sidewall 330
365 Left arm sleeve of the jacket 325
370 Inside surface of the left arm sleeve 365
375 Outside surface of the left arm sleeve 365
380 Left arm aperture of the torso surrounding sidewall 330
385 Right arm sleeve of the jacket 325
395 Inside surface of the right arm sleeve 385
400 Outside surface of the right arm sleeve 385
405 Right arm aperture of the torso surrounding sidewall 330
410 First reinforcement grommet
415 First aperture of the first reinforcement grommet 410
420 Second reinforcement grommet
425 Second aperture of the second reinforcement grommet 420
430 First guide strap
435 Second guide strap
440 Third guide strap
445 Fourth guide strap
450 Fifth guide strap
455 Load on the adjustable strap 265 from the skis 80 weight or the snowboard 81 weight
460 Sixth guide strap
465 Slot in the torso surrounding sidewall 330
470 Fold over hook and loop fastener
475 Fold under hook and loop fastener
480 Upper zipper teeth
485 Lower zipper teeth
490 Zipper slider pull

DETAILED DESCRIPTION

With initial reference to FIG. 1 shown is an upper perspective use view of the ski carrier apparatus 50 that includes the flexible bracket 120 holding the skis 80 together, the adjustable strap 265 looped over the user's 55 shoulder, the first 295 and second 305 means for removable engagement, the cord 285 looped 320 around the toe binding 100 of the ski 80, and the skis 80.

Figure 2:
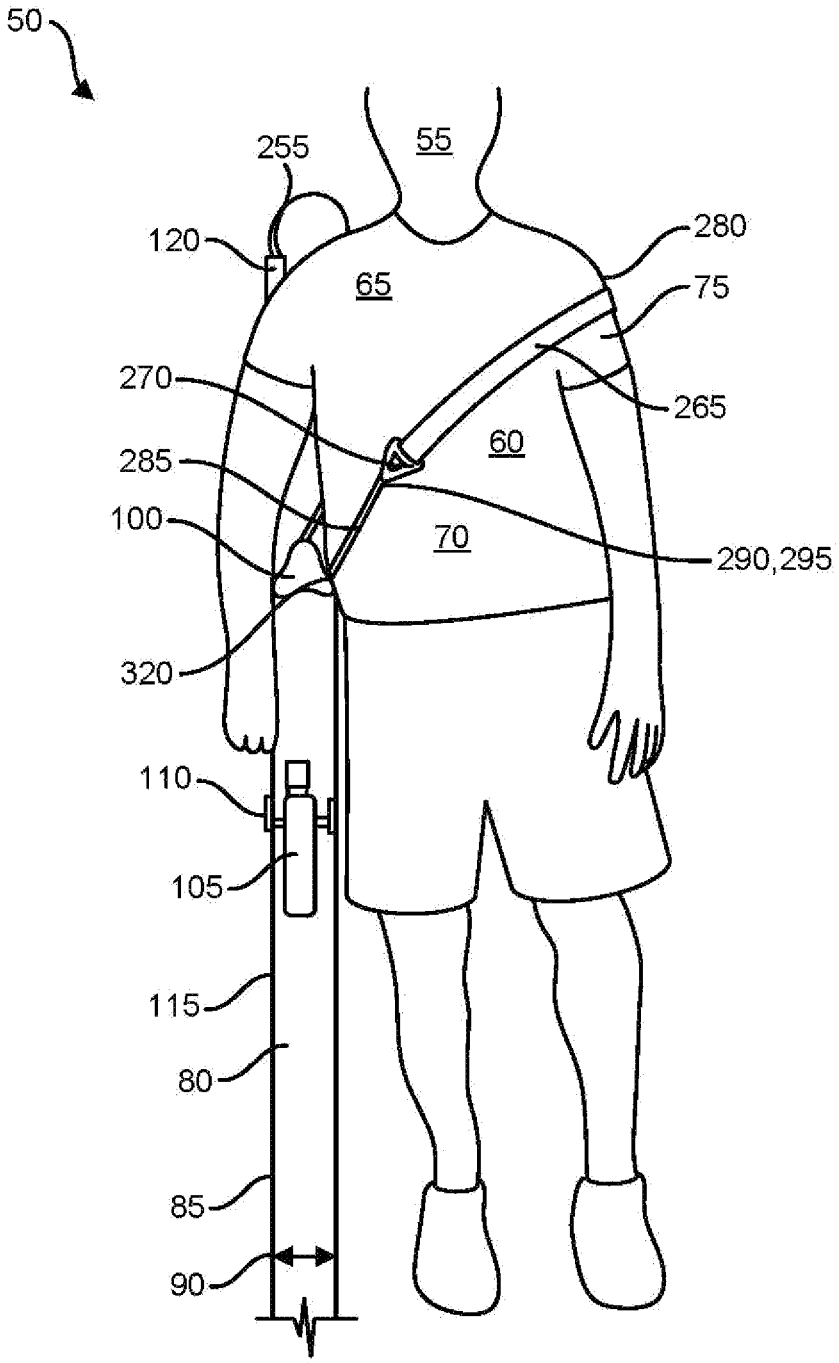
FIG. 2 shows a front elevation use view of the ski carrier apparatus that includes the flexible bracket holding the skis together, the adjustable strap looped over the user's shoulder, the first and second means for removable engagement, the cord looped around the toe binding of the ski, and the skis.

Continuing, FIG. 2 shows a front elevation use view of the ski carrier apparatus 50 that includes the flexible bracket 120 holding the skis 80 together, the adjustable strap 265 looped 280 over the upper torso 65 of the user 55, the first 295 and second 305 means for removable engagement, the cord 285 looped 320 around the toe binding 100 of the ski 80, and the skis 80.

Figure 3:
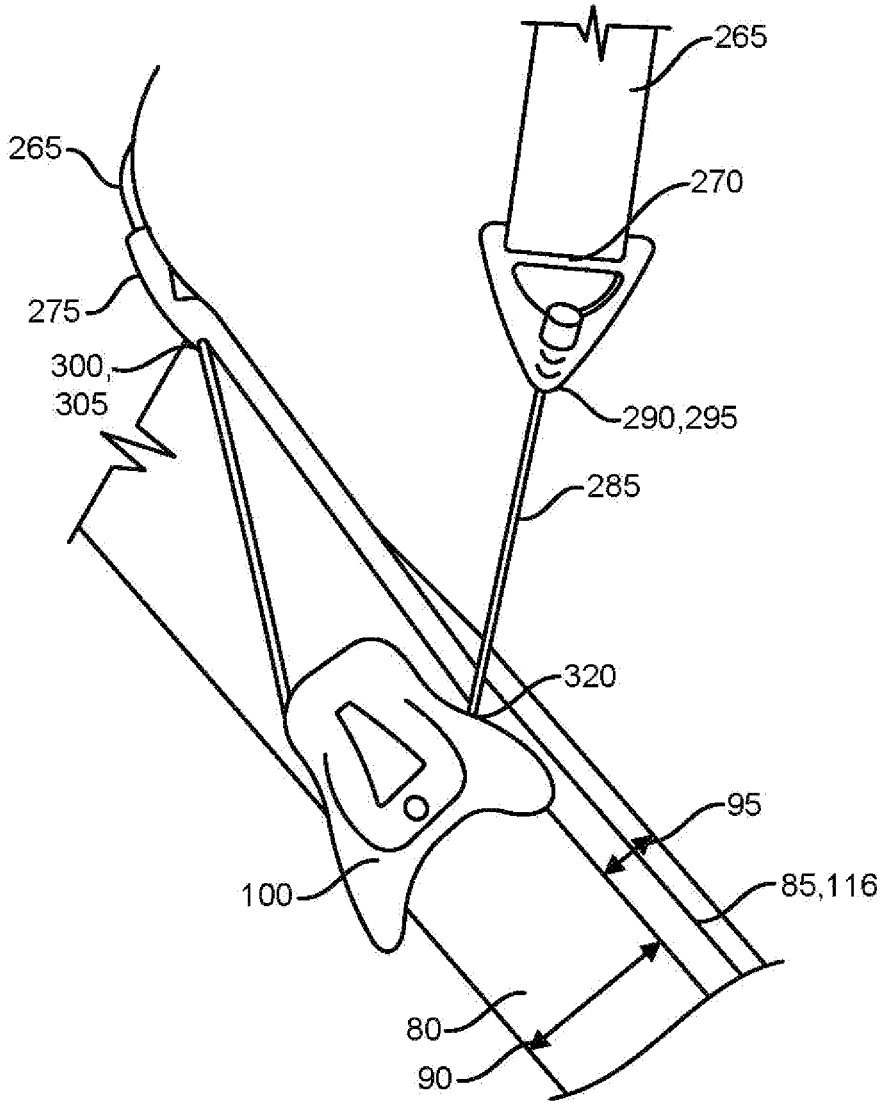
FIG. 3 shows a closeup perspective view of the adjustable strap, the first and second means for removable engagement, the cord looped around the toe binding of the ski, and the skis.

Further, FIG. 3 shows a closeup perspective view of the adjustable strap 265, the first 295 and second 305 means for removable engagement, the cord 285 looped 320 around the toe binding 100 of the ski 80, and the skis 80.

Figure 4:
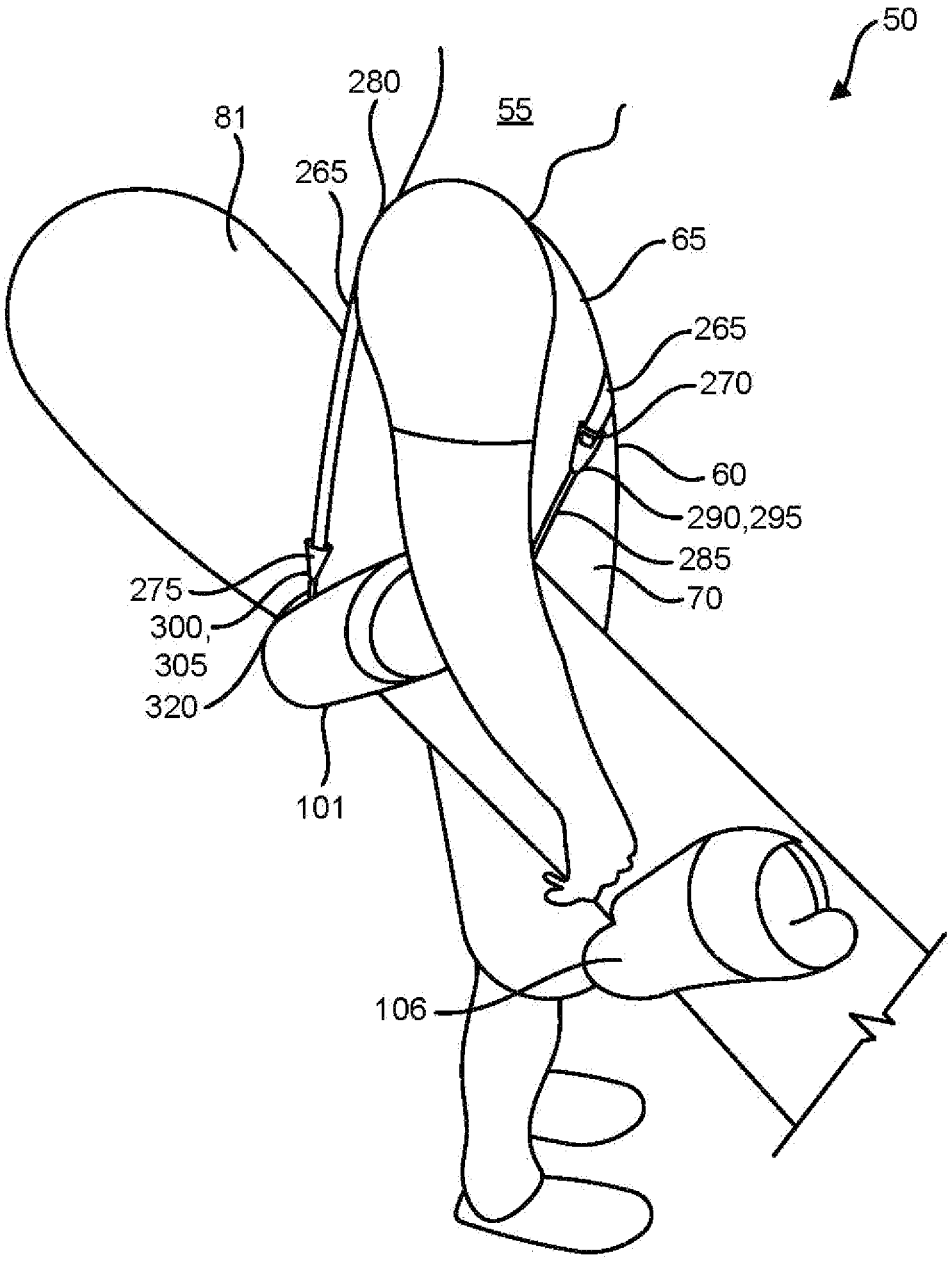
FIG. 4 shows a side elevation use view of the ski carrier apparatus carrying a snowboard that includes the adjustable strap looped over the upper torso of the user, the first and second means for removable engagement, the cord looped around the front foot binding of the snowboard, and the snowboard.

Next, FIG. 4 shows a side elevation use view of the ski carrier apparatus 50 carrying a snowboard 81 that includes the adjustable strap 265 looped 280 over the upper torso 65 of the user 55, the first 295 and second 305 means for removable engagement, the cord 285 looped 320 around the front foot binding 101 of the snowboard 81, and the snowboard 81.

Figure 5:
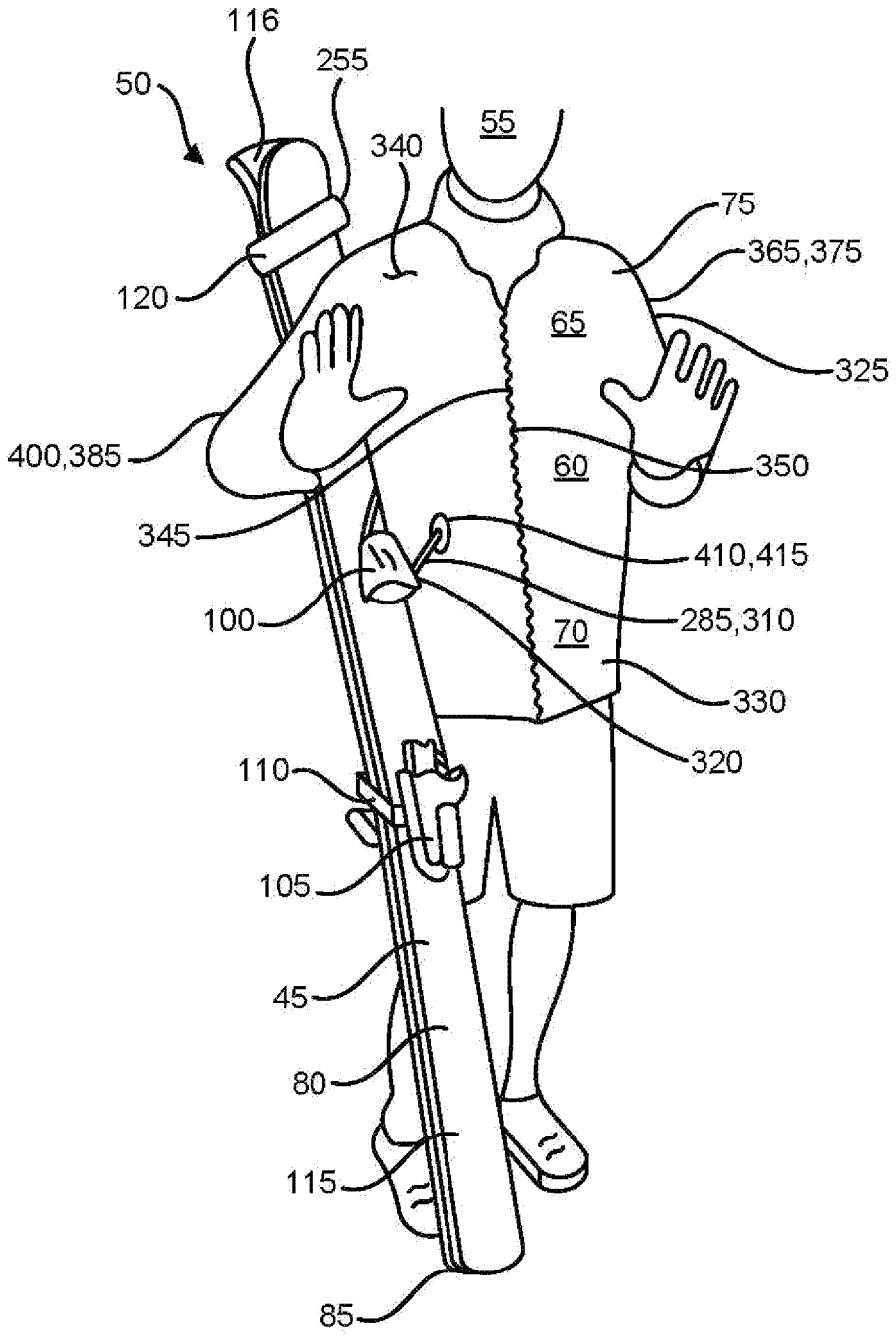
FIG. 5 shows a front elevation use view of the ski carrier apparatus that includes the flexible bracket holding the skis together, the adjustable strap looped over the user's shoulder, however, being underneath a ski jacket, the first and second means for removable engagement also underneath the jacket, the cord disposed through a first aperture therethrough the jacket and a second aperture therethrough the jacket (not shown) with the cord looped around the toe binding of the ski, and the skis.

Moving ahead, FIG. 5 shows a front elevation use view of the ski carrier apparatus 50 that includes the flexible bracket 120 holding the skis 80 together, the adjustable strap 265 looped 280 over the upper torso 65 of the user's 55 shoulder, however, being underneath a ski jacket 325, the first 295 and second 305 means for removable engagement also underneath the jacket 325, the cord 285 disposed through a first aperture 415 therethrough the jacket 325 and a second aperture 425 therethrough the jacket 325 (not shown) with the cord 285 looped 320 around the toe binding 100 of the ski 80, and the skis 80.

Figure 6:
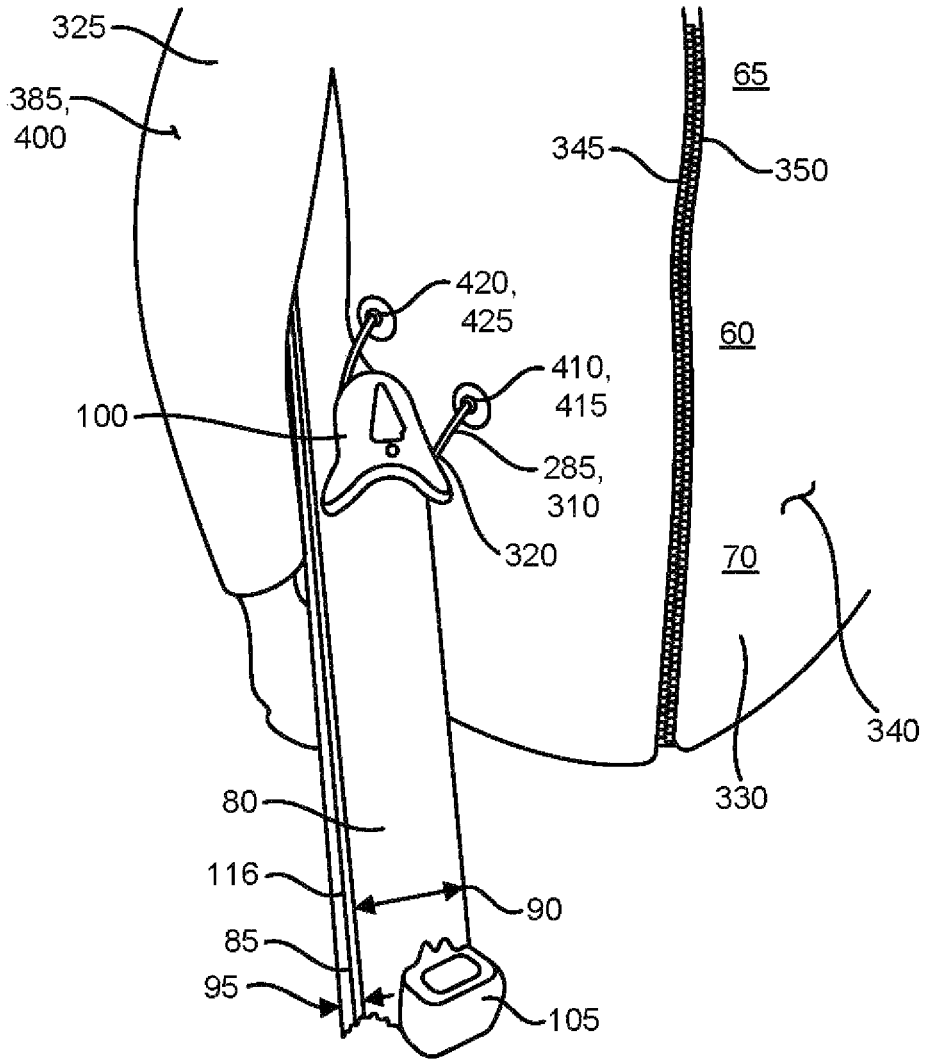
FIG. 6 shows a closeup perspective use view of the ski carrier apparatus that includes the ski jacket, the cord disposed through a first aperture therethrough the jacket and a second aperture disposed therethrough the jacket with the cord looped around the toe binding of the ski, and the skis.

Next, FIG. 6 shows a closeup perspective use view of the ski carrier apparatus 50 that includes the ski jacket 325, the cord 285 disposed through a first aperture 415 therethrough the jacket 325 and a second aperture 425 disposed therethrough the jacket 325 with the cord 285 looped 320 around the toe binding 100 of the ski 80, and the skis 80.

Figure 7:
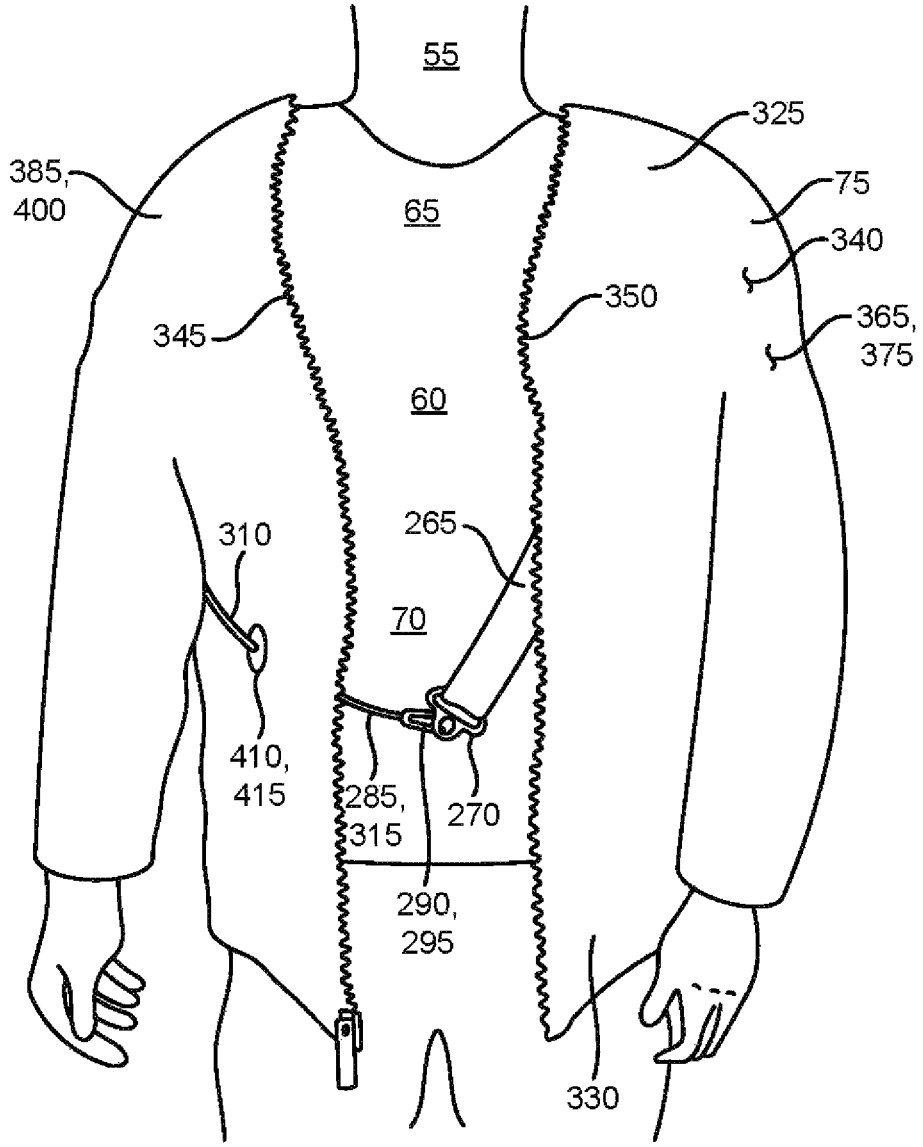
FIG. 7 shows a front elevation use view of a portion of the ski carrier apparatus that includes the adjustable strap looped over the user's shoulder, however, being underneath the ski jacket, the first means for removable engagement, the cord disposed through a first aperture therethrough the jacket and a second aperture therethrough the jacket (not shown) with the cord freely looped outside of the ski jacket.

Continuing, FIG. 7 shows a front elevation use view of a portion of the ski carrier apparatus 50 that includes the adjustable strap 265 looped 280 over the upper torso 65 of the user's 55 shoulder, however, being underneath the ski jacket 325, the first means 295 for removable engagement, the cord 285 disposed through the first aperture 415 therethrough the jacket 325 and a second aperture 425 therethrough the jacket 325 (not shown) with the cord 285 freely looped outside of the ski jacket 325.

Figure 8:
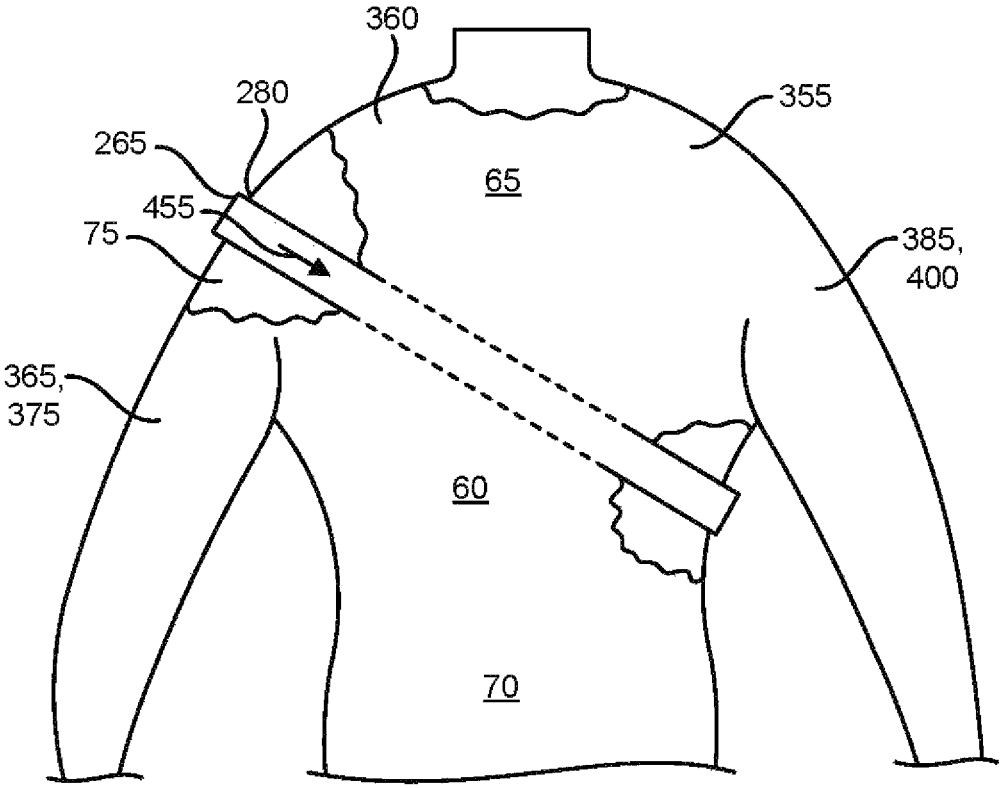
FIG. 8 shows a back elevation view of the user upper torso to show in particular the strap positioning to support the weight load from the skis or snowboard.

Further, FIG. 8 shows a back elevation view of the user 55 upper torso 65 to show in particular the adjustable strap 265 positioning to support the weight load 455 from the skis 80 or snowboard 81, wherein the jacket 325 helps to position the strap 265 in a desirable position in relation to the torso 60 to minimize fatigue and stress for the user 55 from the strap 265 load 455 being from the skis 80 or snowboard 81 weight.

Figure 9:
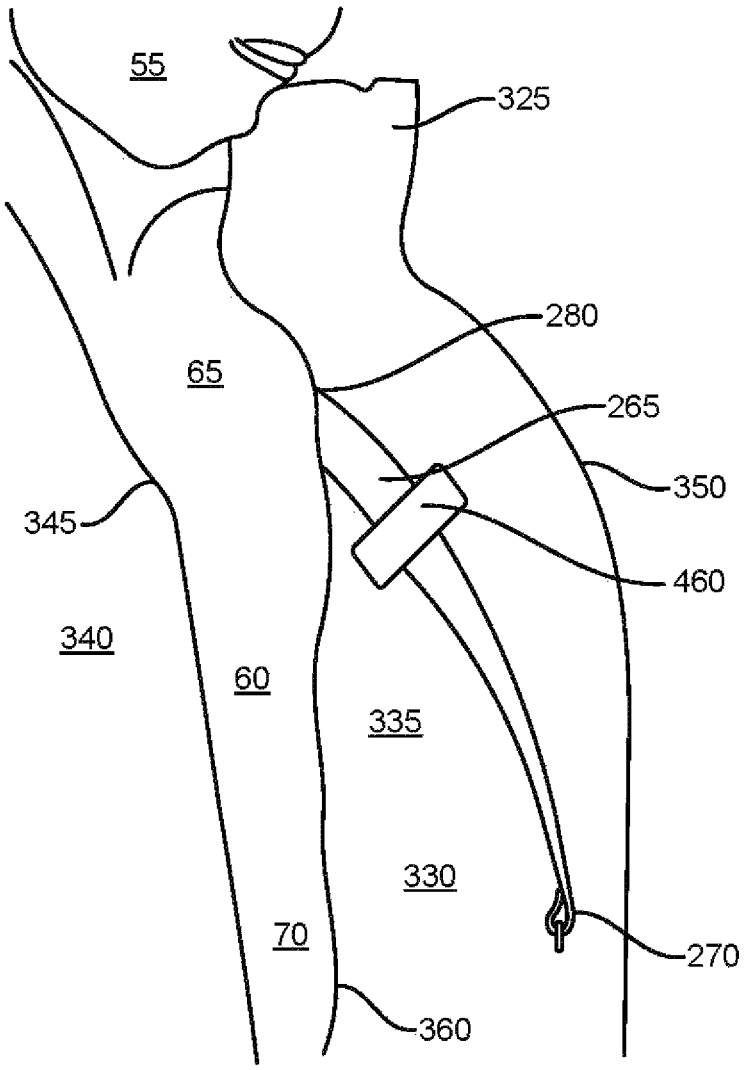
FIG. 9 shows a perspective view of the user with the ski jacket opened to show the inner surface of the left back torso surrounding sidewall to expose the strap and its sixth guide strap that helps to hold the adjustable strap in position on the inner surface of the torso surrounding sidewall of the ski jacket.

Next, FIG. 9 shows a perspective view of the user 55 with the ski jacket 325 opened to show the inner surface 335 of the left back 360 torso surrounding sidewall 330 to expose the adjustable strap 265 and its sixth guide strap 460 that helps to hold the adjustable strap 265 in position on the inner surface 335 of the torso surrounding sidewall 330 of the ski jacket 325.

Figure 10:
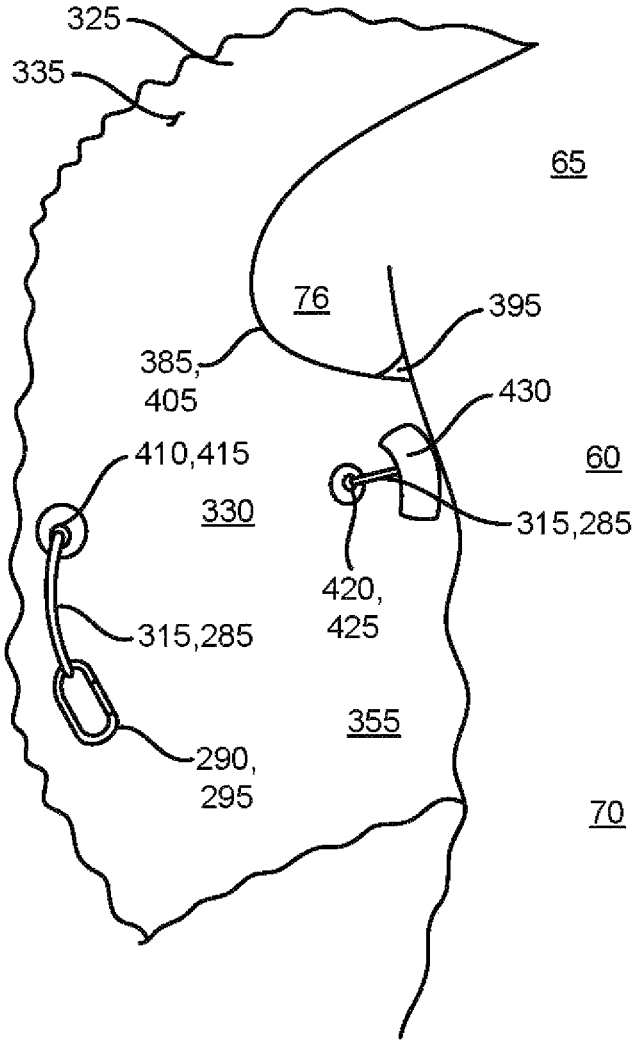
FIG. 10 shows a perspective view of the user with the ski jacket opened to show the inner surface of the right back torso surrounding sidewall to expose the cord and its first and second apertures that are disposed therethrough the ski jacket torso surrounding sidewall.

Moving onward, FIG. 10 shows a perspective view of the user 55 with the ski jacket 325 opened to show the inner surface 335 of the right back 355 torso surrounding sidewall 330 to expose the cord 285 and its first 415 and second 425 apertures that are disposed therethrough the ski jacket 325 torso surrounding sidewall 330.

Figure 11:
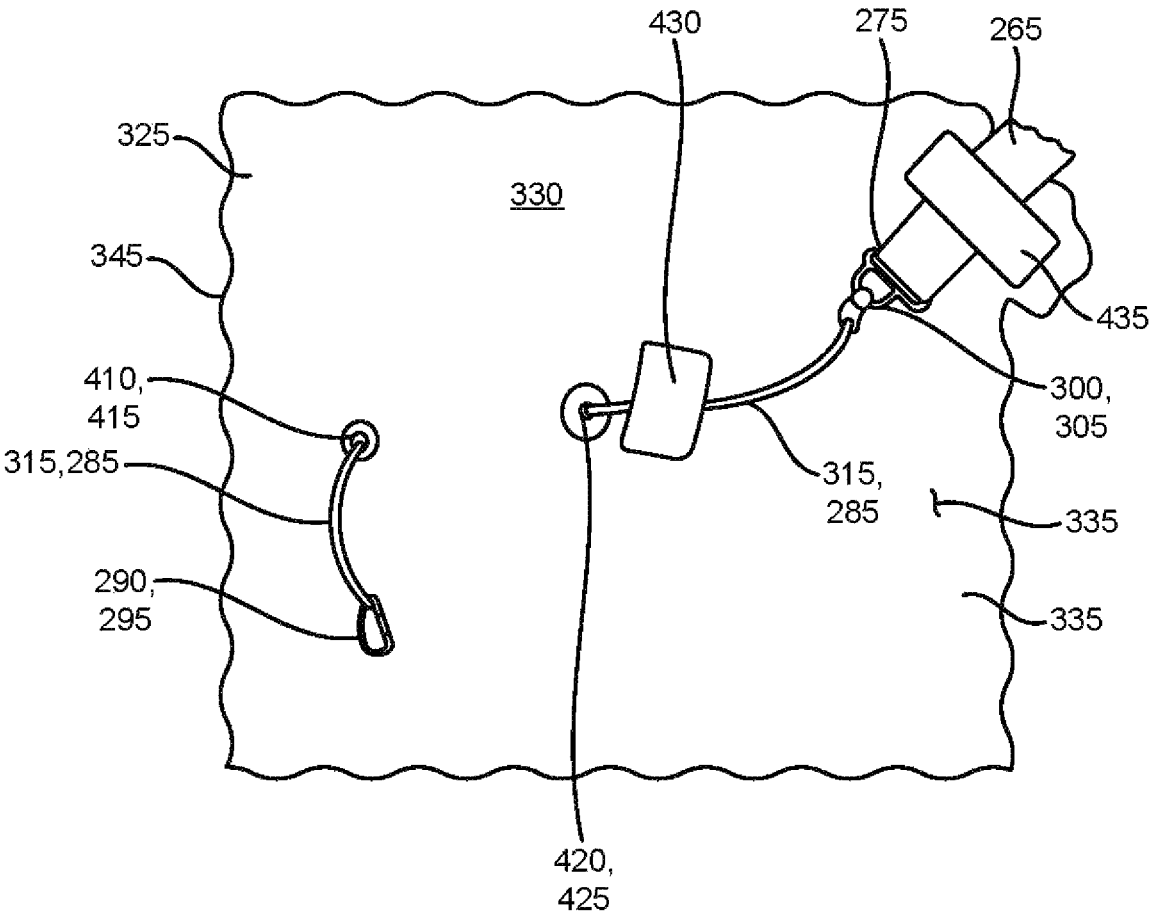
FIG. 11 shows a side elevation view of the ski jacket opened to show the inner surface of the right back to front torso surrounding sidewall with the right hand front zipper margin to expose the cord and its first and second apertures that are disposed therethrough the ski jacket torso surrounding sidewall, plus to show the first guide strap and the second guide strap for the adjustable strap to hold the adjustable strap in position on the inner surface of the torso surrounding sidewall of the ski jacket.

Continuing, FIG. 11 shows a side elevation view of the ski jacket 325 opened to show the inner surface 335 of the right back 355 to front torso surrounding sidewall 330 with the right hand front zipper margin 345 to expose the cord 285 and its first 415 and second 425 apertures that are disposed therethrough the ski jacket 325 torso surrounding sidewall 330, plus to show the first guide strap 430 and the second guide strap 435 for the adjustable strap 265 to hold the adjustable strap 265 in position on the inner surface 335 of the torso surrounding sidewall 330 of the ski jacket 325.

Figure 12:
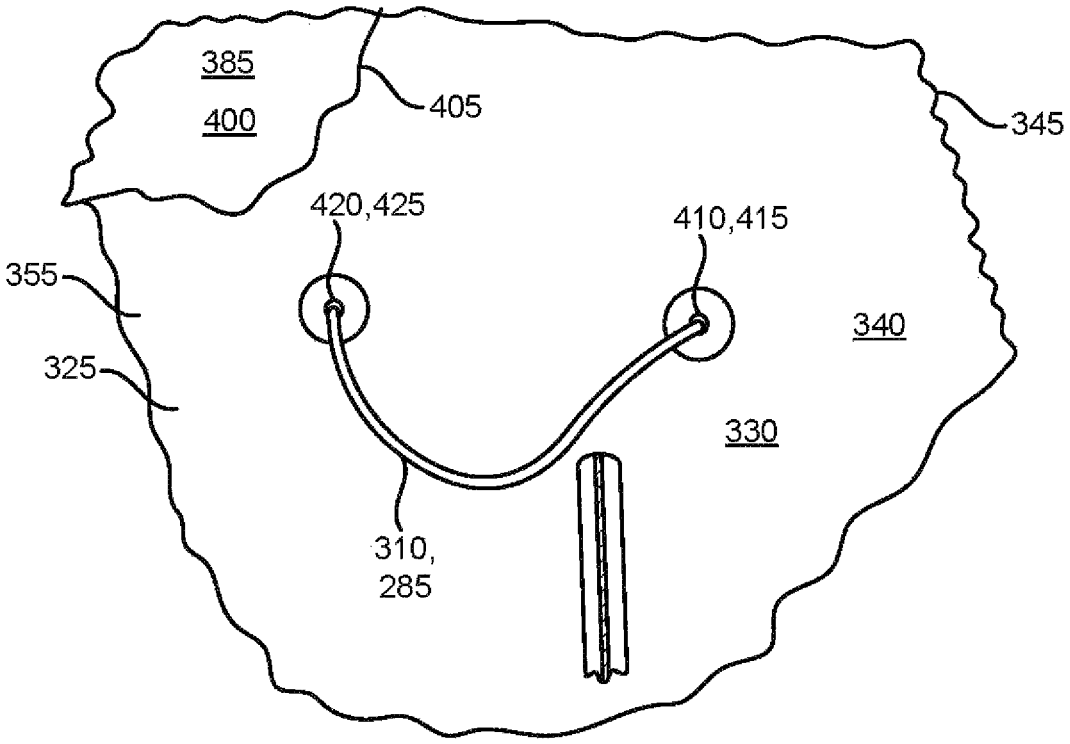

Next, FIG. 12 shows a side elevation view that is opposing to the view shown in FIG. 11, wherein FIG. 12 shows the ski jacket 325 opened to show the outer surface 340 of the torso surrounding sidewall 330 with the right hand front zipper margin 345 to expose the cord 285 external on the jacket 325 and its first 415 and second 425 apertures that are disposed therethrough the ski jacket 325 torso surrounding sidewall 330.

Figure 13:
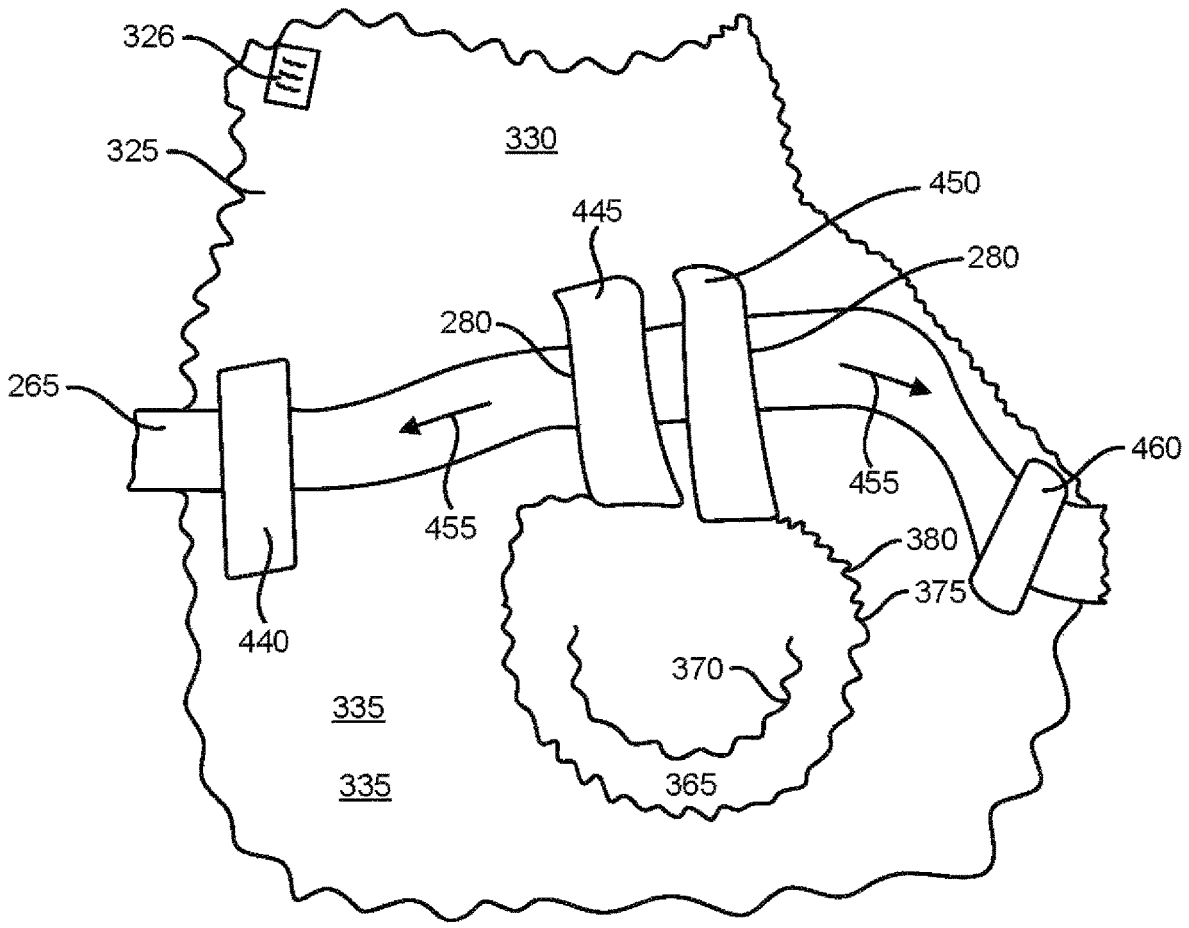
FIG. 13 shows a side elevation view of the ski jacket torso surrounding sidewall of the right back inner surface, noting the inside surface on the left arm sleeve, outside surface of the left arm sleeve, plus the left arm aperture of the ski jacket and the rear collar tag of the ski jacket for positional orientation, further shown is the adjustable strap with the third guide strap, the fourth guide strap, the fifth guide strap, and the sixth guide strap, with all the aforementioned guide straps to all hold position for the adjustable strap on the inner surface of the torso surrounding sidewall, in addition shown are the loads on the adjustable strap from the weight of the skis or snowboard.

Further, FIG. 13 shows a side elevation view of the ski jacket 325 torso surrounding sidewall 330 of the right back 355 inner surface 335, noting the inside surface 370 on the left arm sleeve 365, outside surface 375 of the left arm sleeve 365, plus the left arm aperture 380 of the ski jacket 325 and the rear collar tag 326 of the ski jacket 325 for positional orientation, further shown is the adjustable strap 265 with the third guide strap 440, the fourth guide strap 445, the fifth guide strap 450, and the sixth guide strap 460, with all the aforementioned guide straps to all hold position for the adjustable strap 265 on the inner surface 335 of the torso surrounding sidewall 330, in addition shown are the loads 455 on the adjustable strap 265 from the weight of the skis 80 or snowboard 81.

Figure 14:
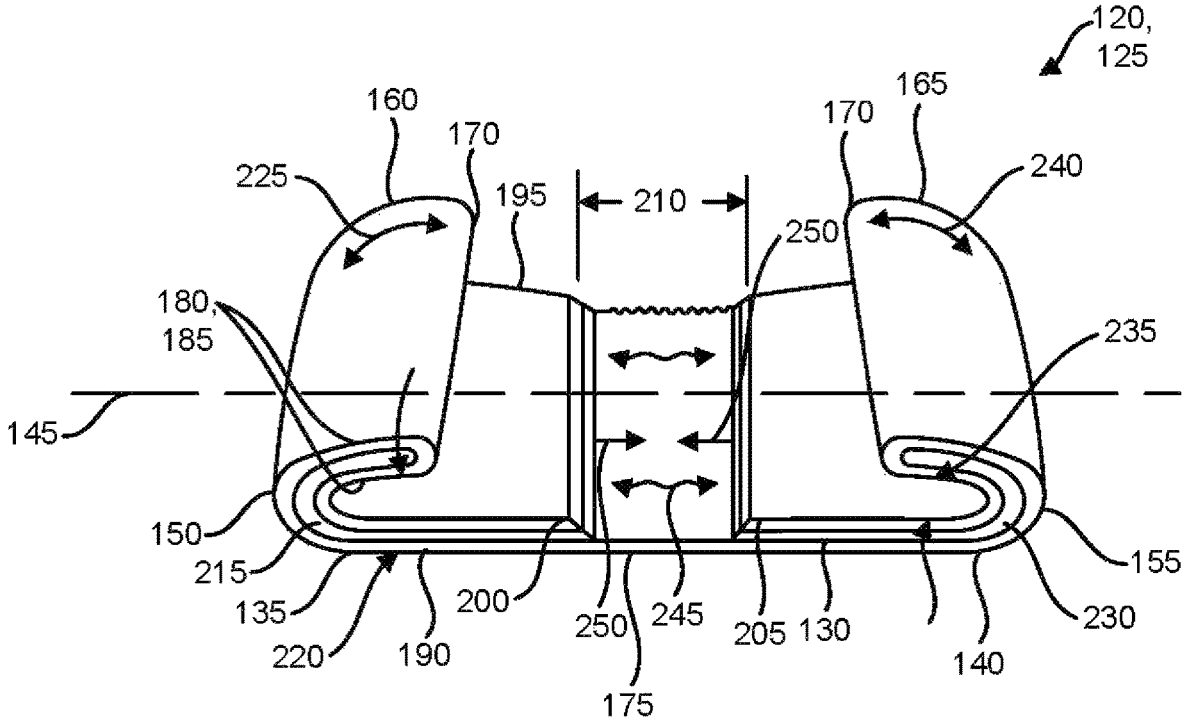
FIG. 14 shows a perspective view of the flexible bracket that includes the "C" shaped channel, the planar base portion, the elastic band portion, with the stretch of the elastic band along with the first and second bendable "U" shaped planar sections to accommodate different width and thickness skis.

Moving onward, FIG. 14 shows a perspective view of the flexible bracket 120 that includes the "C" shaped channel 125, the planar base portion 130, the elastic band portion 175, with the stretch 245 of the elastic band 175 along with the first 215 and second 230 bendable "U" shaped planar sections to accommodate different width 90 and thickness 95 skis 80.

Figure 15:
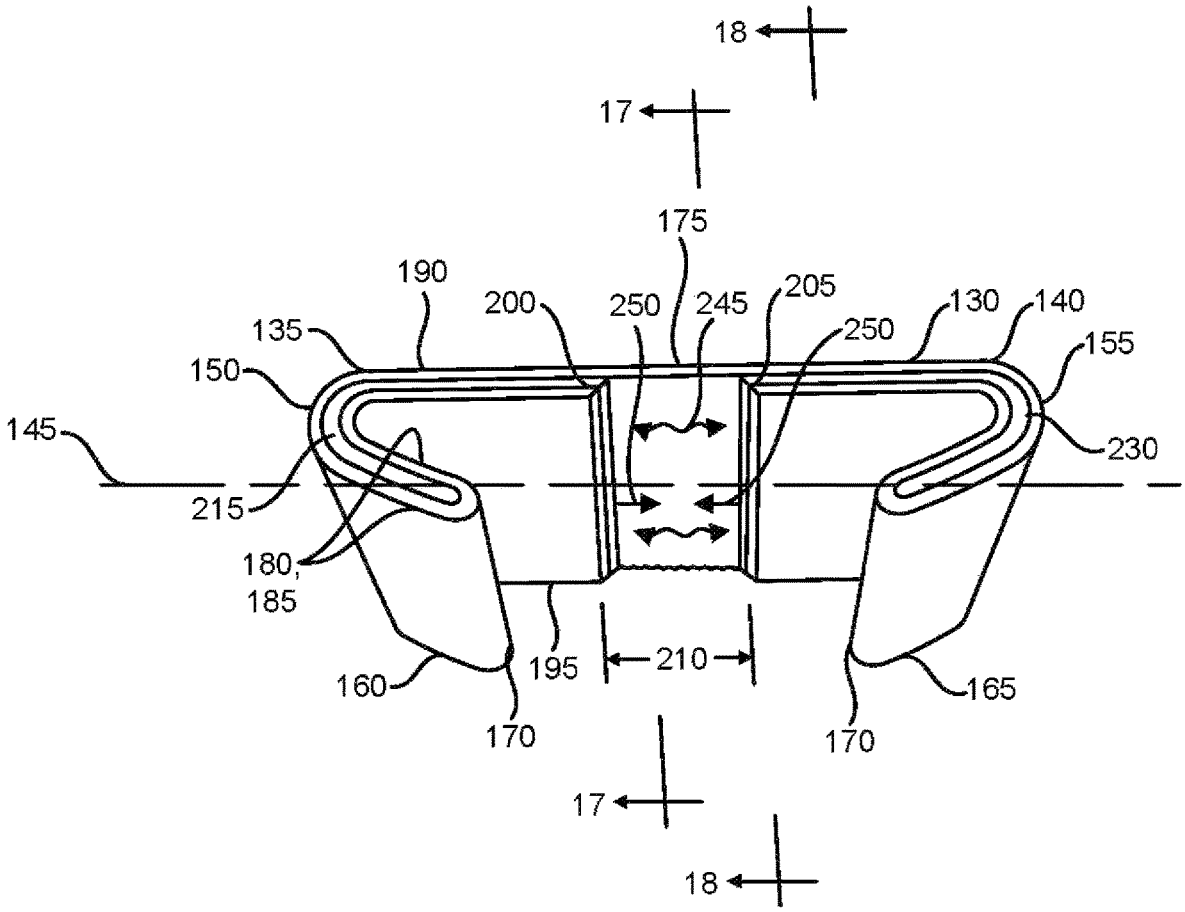
FIG. 15 shows a top perspective view of the flexible bracket that includes the "C" shaped channel, the planar base portion, the elastic band portion, with the stretch of the elastic band along with the first and second bendable "U" shaped planar sections to accommodate different width and thickness skis.

Continuing, FIG. 15 shows a top perspective view of the flexible bracket 120 that includes the "C" shaped channel 125, the planar base portion 130, the elastic band portion 175, with the stretch 245 of the elastic band 175 along with the first 215 and second 230 bendable "U" shaped planar sections to accommodate different width 90 and thickness 95 skis 80.

Figure 16:
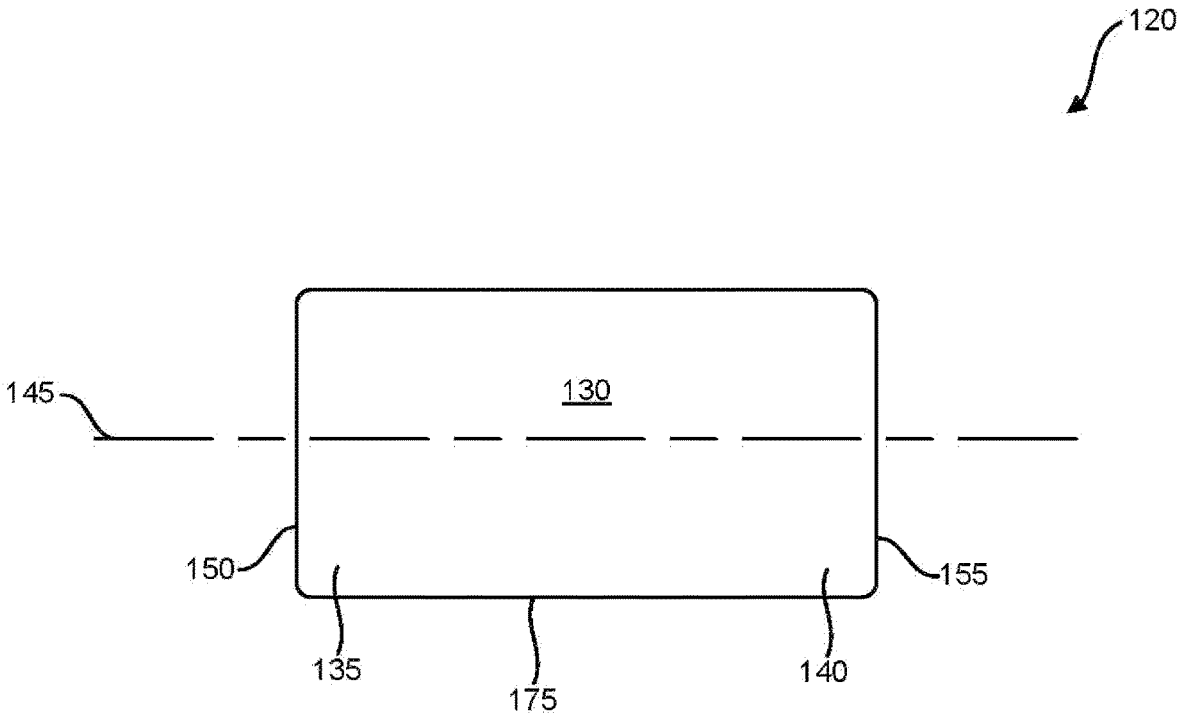
FIG. 16 shows a rear elevation view of the flexible bracket planar base portion.

Next, FIG. 16 shows a rear elevation view of the flexible bracket 120 planar base portion 130.

Figure 17:
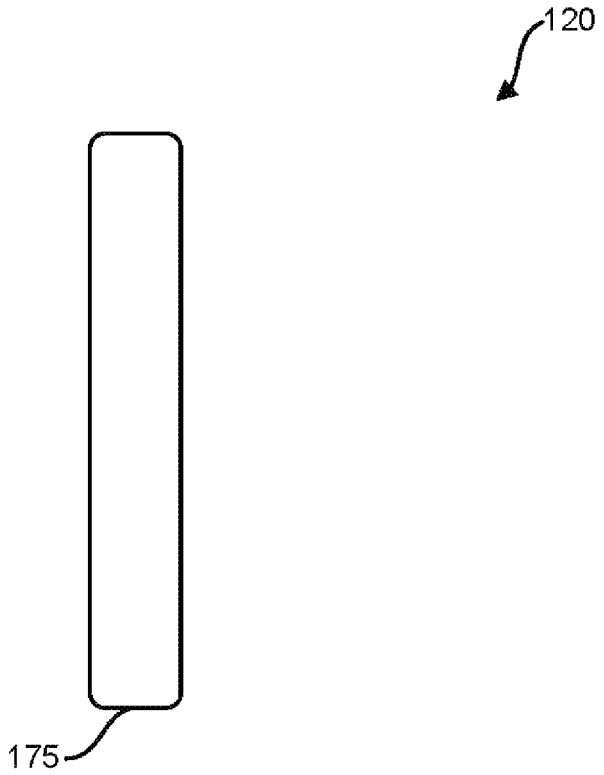

Further, FIG. 17 is section cut 17-17 from FIG. 15, wherein FIG. 17 shows the cross section of the elastic band 175 of the flexible bracket 120 to accommodate different width 90 skis 80.

Figure 18:
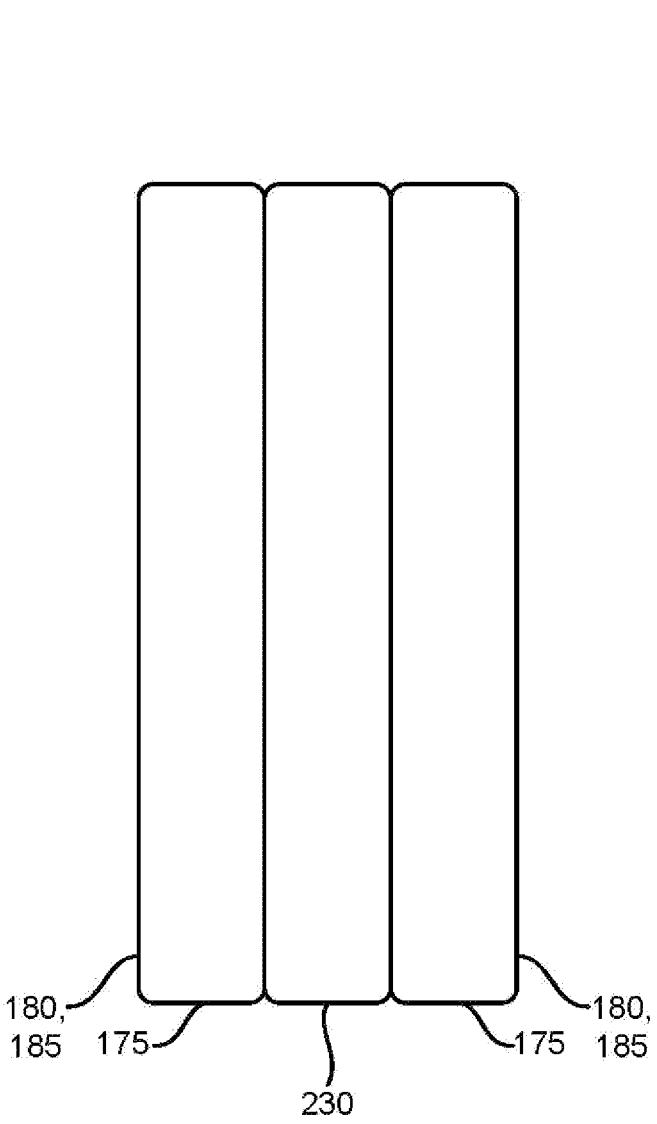

Continuing, FIG. 18 is section cut 18-18 from FIG. 15, wherein FIG. 18 shows the cross section of the second "U" shaped planar section 230 that is multi layered and is rigid and bendable with the elastic band 175 as a covering of the flexible bracket 120 to accommodate different thickness 95 skis 80.

Figure 19:
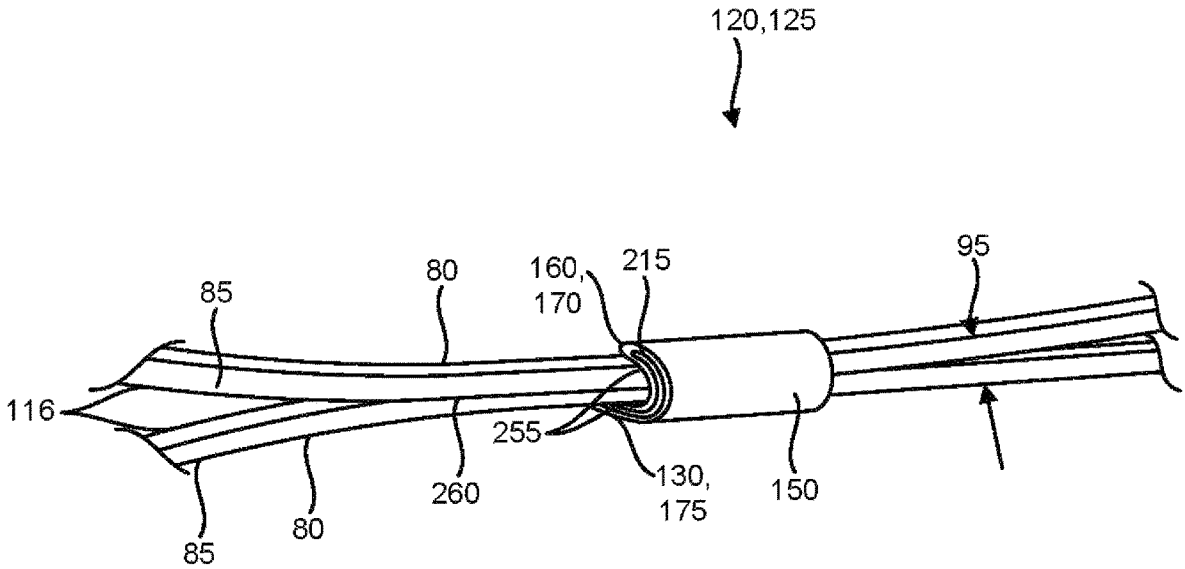
FIG. 19 shows a perspective view of the of the flexible bracket used with the pair of skis where it is shown that the first "U" planar section holding the pair of skis together, wherein the "U" planar section can be bent to accommodate different thickness skis.

Moving onward, FIG. 19 shows a perspective view of the of the flexible bracket 120 used with the pair of skis 80 where it is shown that the first "U" planar section 215 holding the pair of skis 80 together, wherein the first "U" planar section 215 can be bent to accommodate different thickness 95 skis 80.

Figure 20:
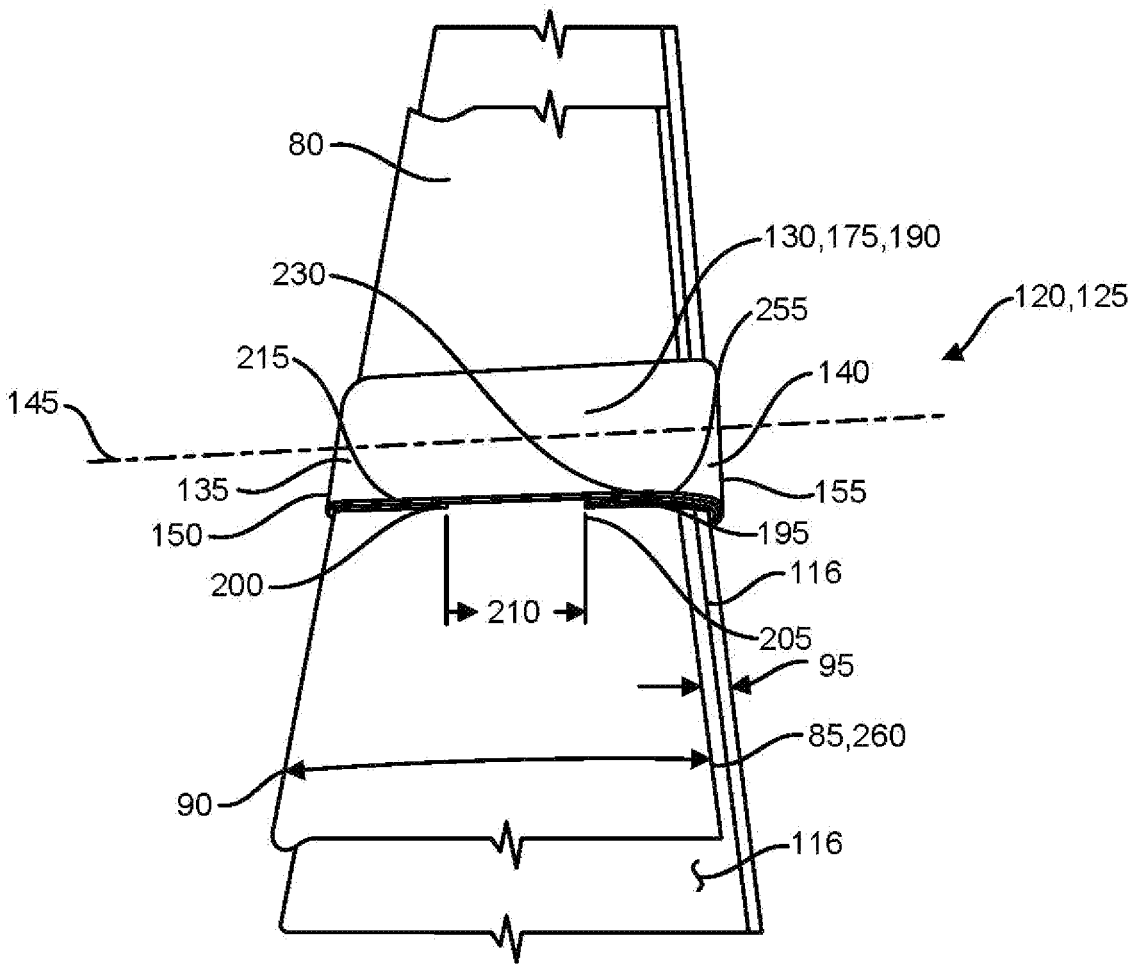
FIG. 20 shows a perspective view of the of the flexible bracket on the planar base portion side that is used with the pair of skis where it is shown that the elastic band can accommodate different width skis to hold the pair of skis together.

Next, FIG. 20 shows a perspective view of the of the flexible bracket 120 on the planar base portion 130 side that is used with the pair of skis 80 where it is shown that the elastic band 175 can accommodate different width 90 skis 80 to hold the pair of skis 80 together.

Figure 21:
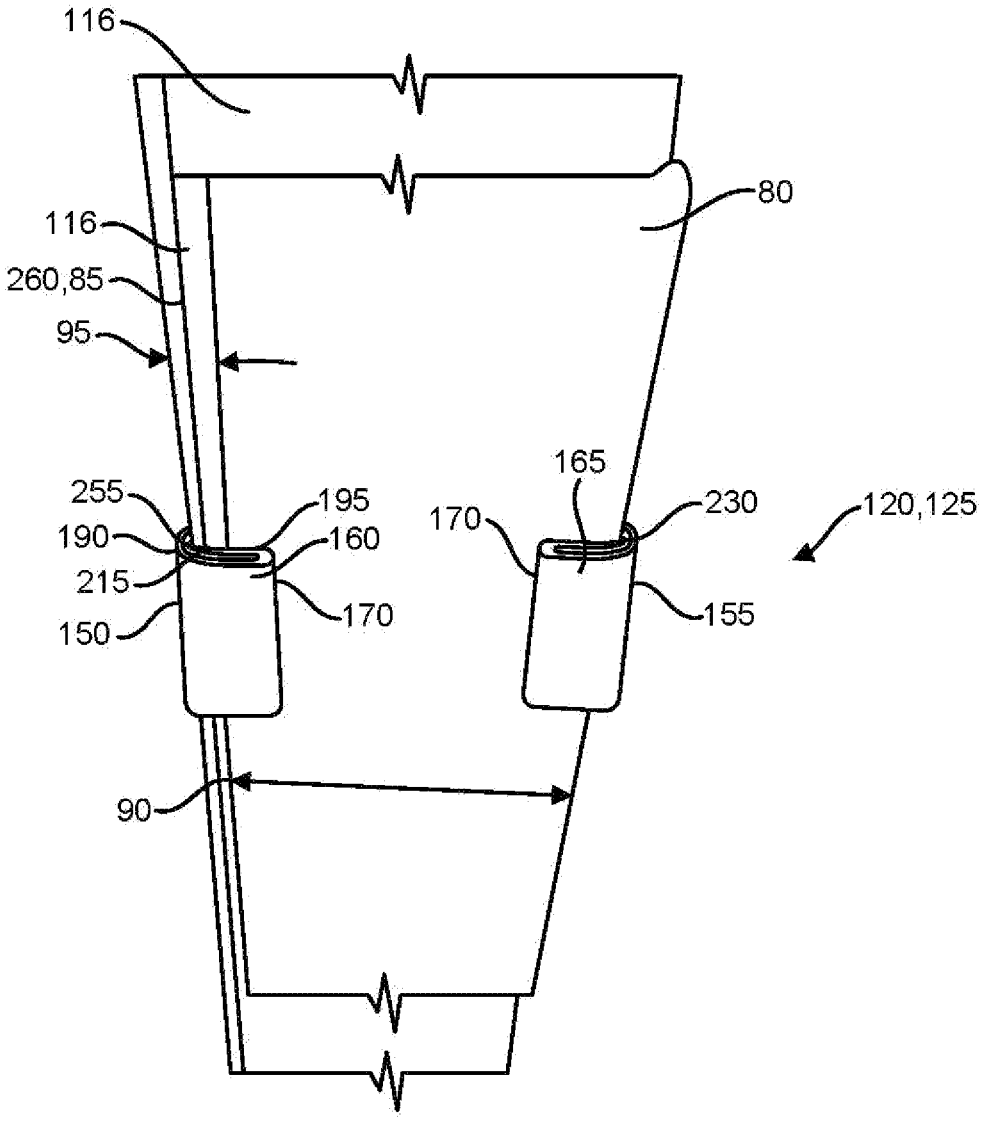

Continuing, FIG. 21 shows a perspective view of the of the flexible bracket 120 on the first 215 and second 230 "U" bendable shaped planar sections side being an opposing view to what is shown in FIG. 20, wherein FIG. 21 shows the first 215 and second 230 "U" bendable shaped planar sections clamping the pair of skis 80 together accommodating both different ski 80 thicknesses 95 via the first 215 and second 230 "U" bendable shaped planar sections and different ski widths 90 via the elastic band 175.

Figure 22:
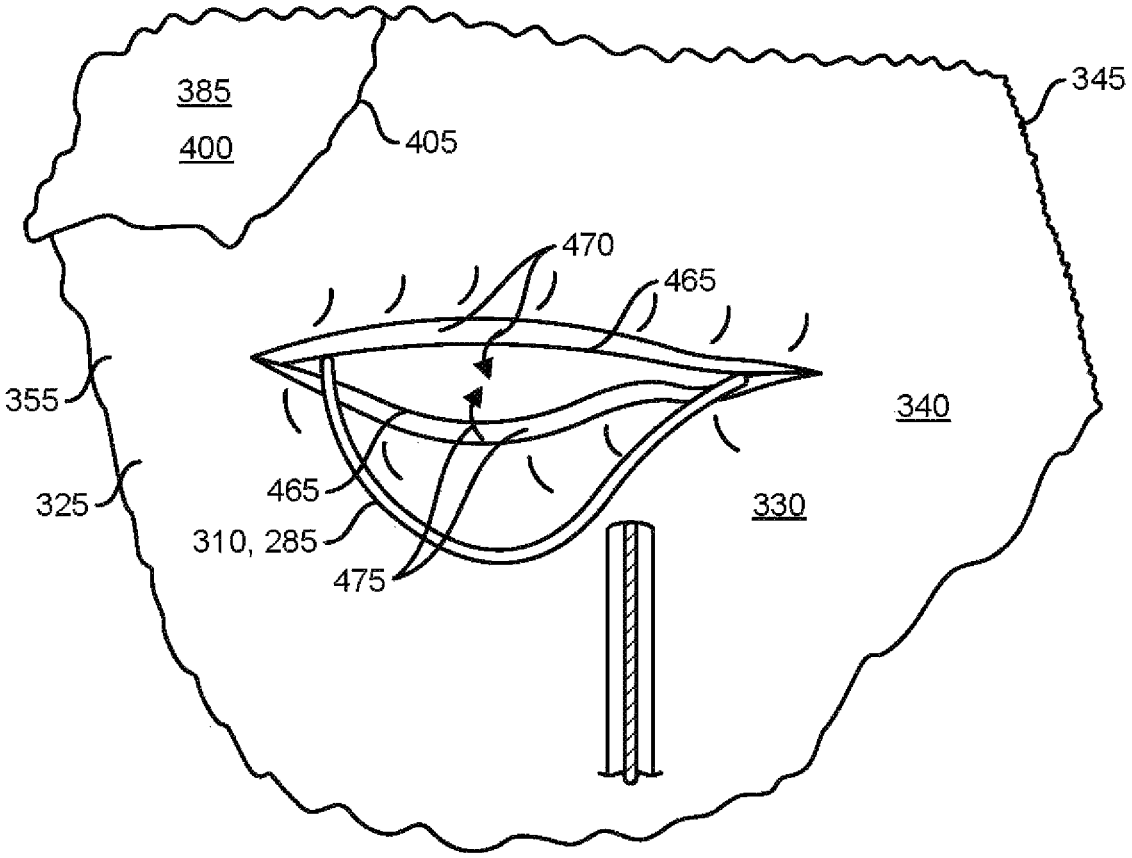
FIG. 22 shows that as an alternative to the first and second apertures disposed therethrough the torso surrounding sidewall of the ski jacket, that can alternatively have a slot disposed therethrough the torso surrounding sidewall for the cord to pass through the ski jacket torso surrounding sidewall, as viewed from the outer surface of the torso surrounding sidewall, also shown is the fold over/under hook and loop fastener to close the slot around the cord or to close the torso surrounding sidewall when the cord is not in use, i.e. not going therethrough the slot, wherein the fold over/under hook and loop fastener is disposed on the outer surface of the torso surrounding sidewall of the ski jacket.

Further, FIG. 22 shows that as an alternative to the first 415 and second 425 apertures disposed therethrough the torso surrounding sidewall 330 of the ski jacket 325, that can alternatively have a slot 465 disposed therethrough the torso surrounding sidewall 330 for the cord 285 to pass through the ski jacket 325 torso surrounding sidewall 330, as viewed from the outer surface 340 of the torso surrounding sidewall 330, also shown is the fold over 470/under 475 hook and loop fastener to close the slot 465 around the cord 285 or to close the torso surrounding sidewall 330 when the cord 285 is not in use, i.e. not going therethrough the slot 465, wherein the fold over 470/under 475 hook and loop fastener is disposed on the outer surface 340 of the torso surrounding sidewall 330 of the ski jacket 325.

Figure 23:
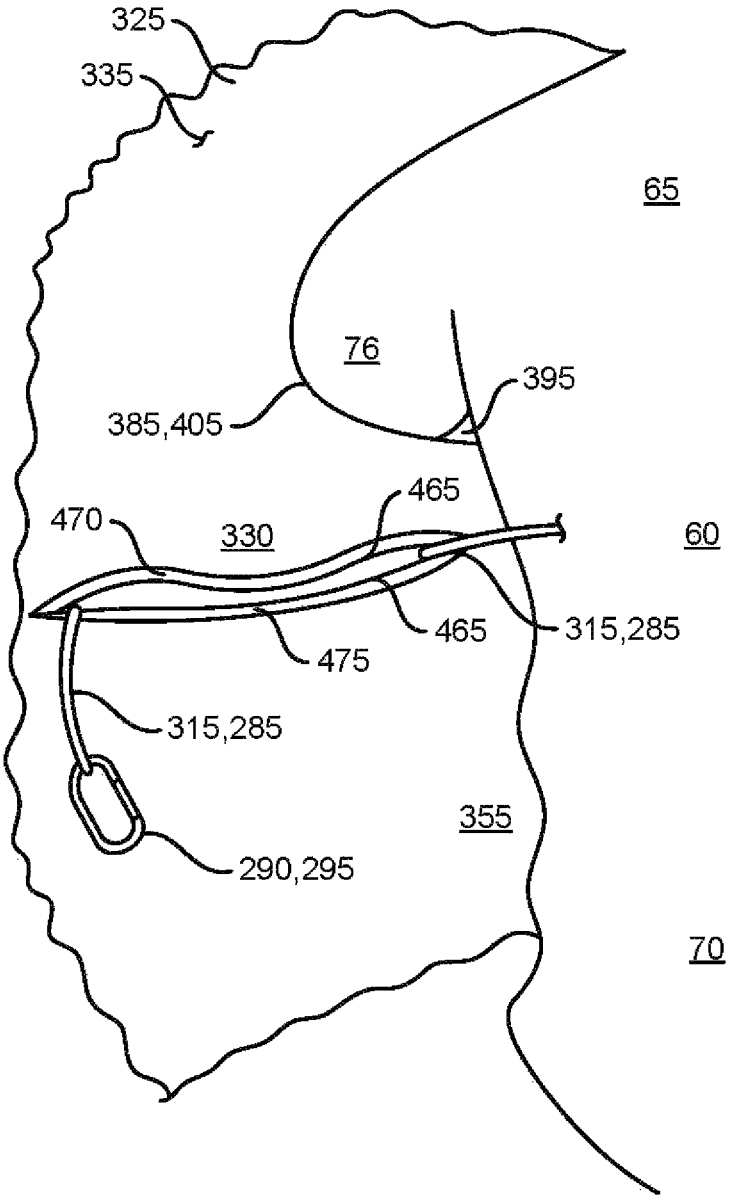

Next, FIG. 23 shows an opposing view to FIG. 22, wherein FIG. 23 shows the slot 465 disposed therethrough the torso surrounding sidewall 330 for the cord 285 to pass through the ski jacket 325 torso surrounding sidewall 330 as viewed from the inner surface 335 of the torso surrounding sidewall 330, also shown is the fold over 470/under 475 hook and loop fastener to close the slot 465 around the cord 285 or to close the torso surrounding sidewall 330 when the cord 285 is not in use, i.e. not going therethrough the slot 465, wherein the fold over 470/under 475 hook and loop fastener is disposed on the outer surface 340 of the torso surrounding sidewall 330 of the ski jacket 325.

Figure 24:
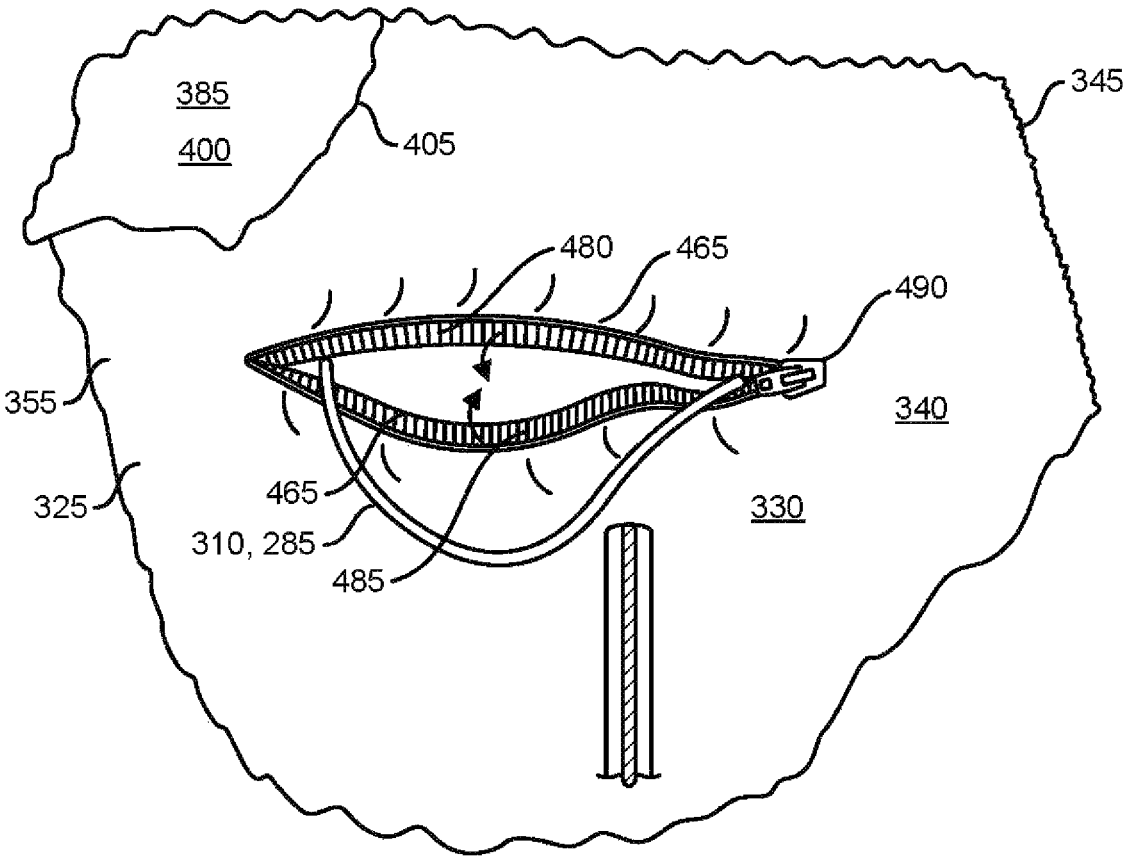
FIG. 24 shows that as an alternative to the first and second apertures disposed therethrough the torso surrounding sidewall of the ski jacket, that can alternatively have a slot disposed therethrough the torso surrounding sidewall for the cord to pass through the ski jacket torso surrounding sidewall, as viewed from the outer surface of the torso surrounding sidewall, also shown is the upper/lower zipper teeth with slider fastener to close the slot around the cord or to close the torso surrounding sidewall when the cord is not in use, i.e. not going therethrough the slot, wherein the upper/lower zipper teeth with slider fastener is disposed on the outer surface of the torso surrounding sidewall of the ski jacket.

Further, FIG. 24 shows that as an alternative to the first 415 and second 425 apertures disposed therethrough the torso surrounding sidewall 330 of the ski jacket 325, that can alternatively have a slot 465 disposed therethrough the torso surrounding sidewall 330 for the cord 285 to pass through the ski jacket 325 torso surrounding sidewall 330, as viewed from the outer surface 340 of the torso surrounding sidewall 330, also shown is the upper 480/lower zipper 485 teeth with slider 490 fastener to close the slot 465 around the cord 285 or to close the torso surrounding sidewall 330 when the cord 285 is not in use, i.e. not going therethrough the slot 465, wherein the upper 480/lower 485 zipper teeth with slider 490 fastener is disposed on the outer surface 340 of the torso surrounding sidewall 330 of the ski jacket 325.

Figure 25:
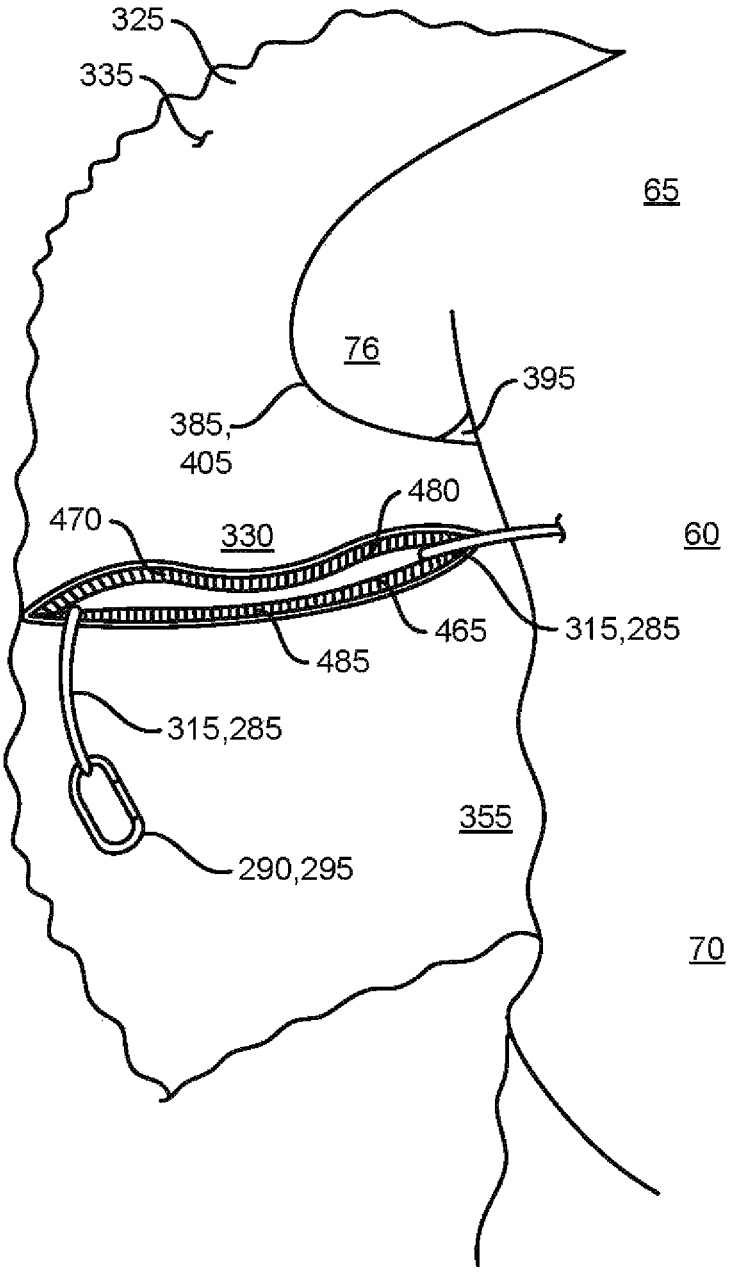

Moving onward, FIG. 25 shows an opposing view to FIG. 24, wherein FIG. 25 shows the slot 465 disposed therethrough the torso surrounding sidewall 330 for the cord 285 to pass through the ski jacket 325 torso surrounding sidewall 330 as viewed from the inner surface 335 of the torso surrounding sidewall 330, also shown is the upper 480/lower 485 zipper teeth with slider 490 fastener to close the slot 465 around the cord 285 or to close the torso surrounding sidewall 330 when the cord 285 is not in use, i.e. not going therethrough the slot 465, wherein the upper 480/lower 485 zipper teeth with slider 490 fastener is disposed on the outer surface 340 of the torso surrounding sidewall 330 of the ski jacket 325.

Broadly in looking at FIGS. 1 to 4, 8, and 14 to 21, the present invention is the ski carrier apparatus 50 for manually carrying skis 80, the ski carrier apparatus 50 includes a flexible bracket 120 in the form of a "C" shaped channel 125 including a planar base portion 130 having a first end portion 135 and an opposing second end portion 140 with a base longitudinal axis 145 spanning therebetween, a first leg 150 and a second leg 155 that each extend in a same direction and parallel to one another respectively from the first 135 and second 140 end portions, the first 150 and second 155 legs each terminate in a respective first 160 and second 165 hook sections that each face inward 170 towards one another, see in particular FIGS. 14 to 21.

Wherein the flexible bracket 120 is constructed of the elastic band 175 that extends through the first hook section 160, continuing to the first leg 150, next to the planar base portion 130, further to the second leg 155, and to the second hook section 165, the elastic band 175 is folded back 180 unto itself to form a double layer 185 comprising a primary layer 190 and a secondary layer 195, wherein the secondary layer 195 terminates at a first margin 200 and a second 205 margin, such that the first 200 and second 205 margins are spaced apart along the longitudinal axis 145 forming a gap 210, again see FIGS. 14 to 21.

Also the flexible bracket 120 is constructed of the first semi rigid bendable "U" shaped planar section 215 that is disposed between the first hook section 160 and the first margin 200 and further disposed between the primary 190 and secondary 195 layers, wherein operationally the first semi rigid bendable "U" shaped planar section 215 adds a selectable shape that is manually formed between the first hook section 160 and the first margin 200 to set a first length 220 of the first leg 150 and corresponding 225 the first hook section 160 to accommodate different size skis 80, being width wise 90 and thickness wise 95.

In addition, the flexible bracket 120 includes the second semi rigid bendable "U" shaped planar section 230 that is disposed between the second hook section 165 and the second margin 205 and further disposed between the primary 190 and secondary 195 layers, wherein operationally the second semi rigid bendable "U" shaped planar section 230 adds a selectable shape that is manually formed between the second hook section 165 and the second margin 205 to set a second length 235 of the second leg 155 and corresponding 240 the second hook section 165 to accommodate different size skis 80 in ski width 90 and thickness 95, wherein operationally after the first 150 and second 155 legs and the first 160 and second 165 hook section and then using the elastic band 175 on a portion disposed between the first 200 and second 205 margins to stretch 245 with a closing bias 250 between the first 150 and second 155 legs and the first 160 and second 165 hook sections to fit over and secure to edges of the skis 80 to ultimately hold 255 the skis together with ski bases 116 in contact 260 with one another, see in particular FIGS. 1, 2, 5, and 14 to 21.

The ski carrier apparatus 50 further includes an adjustable strap 265 having a first strap end 270 and an opposing second strap end 275, wherein operationally the strap 265 is looped 280 around an upper torso 65 of a user 55 and the cord 285 having a first cord end 290 with a first means 295 for removable engagement to the adjustable strap 265 first strap end 270 and an opposing second cord end 300 with a second means 305 for removable engagement to the adjustable strap 265 second strap end 275, wherein operationally the cord 285 is adjacent to a lower torso 70 of the user 55 with the cord 285 looped 320 around a ski toe binding assembly 100 to suspend the skis 80 above the ground allowing the user 55 to carry the skis 80 via walking in a hands free manner, see FIGS. 1 to 13, and 22 to 25.

As an option the ski carrier apparatus 50 can also include the jacket 325 that includes a torso surrounding sidewall 330 with an inner surface 335 and an outer surface 340, also a left arm sleeve 365 with a left arm aperture 380 disposed therethrough the surrounding sidewall 330 and a right arm sleeve 385 with a right arm aperture 405 disposed therethrough the surrounding sidewall 330, the left arm sleeve 365 having a left sleeve inside surface 370 and a left sleeve outside surface 375 and the right arm sleeve 385 having a right sleeve inside surface 395 and a right sleeve outside surface 400. The jacket 325 also includes a first reinforcement grommet 410 defining a first aperture 415 disposed therethrough the surrounding sidewall 330 positioned adjacent to a right hand front zipper 345 of the surrounding sidewall 330 and a second reinforcement grommet 420 defining a second aperture 425 therethrough the surrounding sidewall 330 positioned adjacent to the right arm aperture 405, see FIGS. 5 to 13, and 22 to 25.

The jacket further 325 includes a first guide strap 430 disposed on the inner surface 335 positioned adjacent to the second aperture 425, wherein the cord 285 is disposed therethrough the first 415 and second 425 apertures and the first guide strap 430 such that a primary portion 310 of the cord 285 between the first 415 and second 425 apertures is adjacent to the outer surface 340 and a secondary portion 315 of the cord 285 remains adjacent to the inner surface 335 and a second guide strap 435 disposed on the inner surface 335 positioned adjacent to a right back 355 of the surrounding sidewall 330, plus a third guide strap 440 disposed on the inner surface 335 positioned adjacent to a left back 360 of the surrounding sidewall 330, again see FIGS. 5 to 13, and 22 to 25.

The jacket 325 also includes a fourth guide strap 445 disposed on the left sleeve inside surface 370 adjacent to the left arm aperture 380 and a fifth guide strap 450 disposed on the left sleeve inside surface 370 adjacent to the left arm aperture 380 further positioned to be in line with the fourth guide strap 445 to operationally position the adjustable strap 265 against a left upper arm 75 of the user 55 to distribute the load 455 from the skis 80 on the adjustable strap 265 in the least discomforting manner to the user 55. Further included in the jacket 325 is a sixth guide strap 460 disposed on the inner surface 335 positioned adjacent to a left hand front zipper 350 of the surrounding sidewall 330, wherein the adjustable strap 265 is disposed therethrough the second 435, third 440, fourth 445, fifth 450, and sixth 460 guide straps, wherein the cord 285 first means 295 for removable engagement is connected to the adjustable strap 265 first strap end 270 and the opposing second cord end 300 with the second means 305 for removable engagement is connected to the adjustable strap 265 second strap end 275, wherein the first means 295 for removable engagement facilitates the surrounding sidewall 330 to be removably engageable as between the left 350 and right 345 hand front zippers of the surrounding sidewall 330, again see FIGS. 5 to 13, and 22 to 25.

As an option for the ski carrier apparatus 50 for manually carrying skis 80, wherein the first 215 and second 230 semi rigid bendable "U" shaped planar sections are each sized and configured to selectably conform to and hold in a tight-fitting cup like manner 255, 260 around the edges 85 of the skis 80 to removably secure the flexible bracket 120 to the skis 80, see in particular FIGS. 19, 20, and 21.

A further option for the ski carrier apparatus 50 for manually carrying skis 80, wherein the cord 285 has a diameter that is no more than ten (10) percent of a width of the strap 265, to operationally facilitate the cord 285 to fit under the ski toe binding assembly 100 of the ski 80 or a front foot binding 101 of a snowboard 81, wherein the strap 265 width is wider to increase a pressure loading area on the upper torso 65 to minimize fatigue and stress for the user from a strap load 455 on the strap 265 being from a weight of the skis 80 or a weight of the snowboard 81, see FIGS. 1, 2, 4, and 8.

Continuing, alternatively for the ski carrier apparatus 50 for manually carrying skis 80, wherein the first 410 and second 420 reinforcement grommets defining the first 415 and second 425 apertures that are both disposed therethrough the torso surrounding sidewall 330 respectively are all collectively replaced positionally by a slot 465 disposed therethrough the torso surrounding sidewall 330, with the slot 465 located as between the first 415 and second 425 apertures previous positions. Wherein, the primary portion 310 of the cord 285 forms the loop as between being disposed therethrough the slot 465, with the loop being positioned adjacent to the outer surface 340 of the torso surrounding sidewall 330, further the loop of the cord 285 is looped around the ski toe binding assembly 100 of the ski 80 from the pair of skis 80 to suspend the skis 80 above the ground allowing the user 55 to carry the skis 80 via walking in a hands free manner, see in particular FIGS. 1 to 3, 5, 6, and 22 to 25, further the loop of the cord 285 can be looped around the front foot binding 101 of the snowboard 81 to suspend the snowboard 81 above the ground allowing the user 55 to carry the snowboard 81 via walking in a hands free manner, see in particular FIG. 4.

Further, alternatively for the ski carrier apparatus 50 for manually carrying skis 80, wherein the slot 465 further includes a fold over hook and loop fastener 470 and an opposing fold under hook and loop fastener 475 that are mated together to one another to close the slot 465 onto itself to seal the torso surrounding sidewall 330 around the primary portion 310 of the cord 285 formed in the loop, see in particular FIGS. 22 and 23.

Also further, optionally for the ski carrier apparatus 50 for manually carrying skis 80, wherein the slot 465 further includes an upper zipper teeth 480 and an opposing lower zipper teeth 485 and a zipper slider pull 490 slidably engaged to both the upper 480 and lower 485 zipper teeth, wherein the zipper slider pull 490 removably engages the upper 480 and lower 485 zipper teeth to close the slot 465 onto itself to seal the torso surrounding sidewall 330 around the primary portion 310 of the cord 285 formed in the loop, see in particular FIGS. 24 and 25.

CONCLUSION

Accordingly, the present invention of a ski carrier apparatus has been described with some degree of particularity directed to the embodiments of the present invention. It should be appreciated, though; that the present invention is defined by the following claims construed in light of the prior art so modifications of the changes may be made to the exemplary embodiments of the present invention without departing from the inventive concepts contained therein.

The invention claimed is:

1. A ski carrier apparatus for a user manually carrying a pair of skis, said ski carrier apparatus comprising:

(a) a flexible bracket in the form of a "C" shaped channel including a planar base portion having a first end portion and an opposing second end portion with a base longitudinal axis spanning therebetween, a first leg and a second leg that each extend in a same direction and parallel to one another respectively from said first and second end portions, said first and second legs each terminate in a respective first and second hook sections that each face inward towards one another, wherein said flexible bracket is constructed of;

(a)i an elastic band that extends through said first hook section, continuing to said first leg, next to said planar base portion, further to said second leg, and to said second hook section, said elastic band is folded back unto itself to form a double layer comprising a primary layer and a secondary layer, wherein said secondary layer terminates at a first margin and a second margin, such that said first and second margins are spaced apart along said longitudinal axis forming a gap;

(a)ii a first semi rigid bendable "U" shaped planar section that is disposed between said first hook section and said first margin and further disposed between said primary and secondary layers, wherein operationally said first semi rigid bendable "U" shaped planar section adds a selectable shape that is manually formed between said first hook section and said first margin to set a first length of said first leg and corresponding said first hook section to accommodate different size skis;

(a)iii a second semi rigid bendable "U" shaped planar section that is disposed between said second hook section and said second margin and further disposed between said primary and secondary layers, wherein operationally said second semi rigid bendable "U" shaped planar section adds a selectable shape that is manually formed between said second hook section and said second margin to set a second length of said second leg and corresponding said second hook section to accommodate different size skis in ski width and thickness, wherein operationally after said first and second legs and said first and second hook section and then using said elastic band on a portion disposed between said first and second margins to stretch with a closing bias between said first and second legs and said first and second hook sections to selectably fit over and secure to edges of the skis to ultimately hold the skis together with ski bases in contact with one another;

(b) an adjustable strap having a first strap end and an opposing second strap end, wherein operationally said strap is looped around an upper torso of a user; and (c) a cord having a first cord end with a first means for removable engagement to said adjustable strap first strap end and an opposing second cord end with a second means for removable engagement to said adjustable strap second strap end, wherein operationally said cord is adjacent to a lower torso of the user with the cord looped around a ski toe binding assembly of a ski from the pair of skis to suspend the skis above the ground allowing the user to carry the skis via walking in a hands free manner.

2. A ski carrier apparatus for manually carrying skis according to claim 1 wherein said first and second semi rigid bendable "U" shaped planar sections are each sized and configured to selectably conform to and hold in a tight-fitting cup like manner around the edges of the skis to removably secure said flexible bracket to the skis.

3. A ski carrier apparatus for manually carrying skis according to claim 2 wherein said cord has a diameter that is no more than ten (10) percent of a width of said strap, to operationally facilitate said cord to fit under the ski toe binding assembly of the ski, wherein said strap width is wider to increase a pressure loading area on the upper torso to minimize fatigue and stress for the user from a strap load on said strap being from a weight of the skis.

4. A ski carrier apparatus for a user manually carrying skis, said ski carrier apparatus comprising:

(a) a flexible bracket in the form of a "C" shaped channel including a planar base portion having a first end portion and an opposing second end portion with a base longitudinal axis spanning therebetween, a first leg and a second leg that each extend in a same direction and parallel to one another respectively from said first and second end portions, said first and second legs each terminate in a respective first and second hook sections that each face inward towards one another, wherein said flexible bracket is constructed of;

(a)i an elastic band that extends through said first hook section, continuing to said first leg, next to said planar base portion, further to said second leg, and to said second hook section, said elastic band is folded back unto itself to form a double layer comprising a primary layer and a secondary layer, wherein said secondary layer terminates at a first margin and a second margin, such that said first and second margins are spaced apart along said longitudinal axis forming a gap;

(a)ii a first semi rigid bendable "U" shaped planar section that is disposed between said first hook section and said first margin and further disposed between said primary and secondary layers, wherein operationally said first semi rigid bendable "U" shaped planar section adds a selectable shape that is manually formed between said first hook section and said first margin to set a first length of said first leg and corresponding said first hook section to accommodate different size skis;

(a)iii a second semi rigid bendable "U" shaped planar section that is disposed between said second hook section and said second margin and further disposed between said primary and secondary layers, wherein operationally said second semi rigid bendable "U" shaped planar section adds a selectable shape that is manually formed between said second hook section and said second margin to set a second length of said second leg and corresponding said second hook section to accommodate different size skis in ski width and thickness, wherein operationally after said first and second legs and said first and second hook section and then using said elastic band on a portion disposed between said first and second margins to stretch with a closing bias between said first and second legs and said first and second hook sections to selectably fit over and secure to edges of the skis to ultimately hold the skis together with ski bases in contact with one another;

(b) an adjustable strap having a first strap end and an opposing second strap end, wherein operationally said strap is looped around an upper torso of a user;

(c) a cord having a first cord end with a first means for removable engagement to said adjustable strap first strap end and an opposing second cord end with a second means for removable engagement to said adjustable strap second strap end, wherein operationally said cord is adjacent to a lower torso of the user with the cord looped around a ski toe binding assembly to suspend the skis above the ground allowing the user to carry the skis via walking in a hands free manner;

(d) a jacket that includes a torso surrounding sidewall with an inner surface and an outer surface, also a left arm sleeve with a left arm aperture disposed therethrough said surrounding sidewall and a right arm sleeve with a right arm aperture disposed therethrough said surrounding sidewall, said left arm sleeve having a left sleeve inside surface and a left sleeve outside surface and said right arm sleeve having a right sleeve inside surface and a right sleeve outside surface;

(d)i a first reinforcement grommet defining a first aperture disposed therethrough said torso surrounding sidewall positioned adjacent to a right hand front zipper of said surrounding sidewall, wherein a primary portion of said cord is disposed therethrough said first reinforcement grommet;

(d)ii a second reinforcement grommet defining a second aperture therethrough said torso surrounding sidewall positioned adjacent to said right arm aperture, wherein said primary portion of said cord is also disposed therethrough said second reinforcement grommet, wherein said primary portion of said cord forms a loop as between said first and second reinforcement grommets, with said loop being positioned adjacent to said outer surface of said torso surrounding sidewall;

(d)iii a first guide strap disposed on said inner surface positioned adjacent to said second aperture, wherein said cord is disposed therethrough said first and second apertures and said first guide strap such that said primary portion of said cord between said first and second apertures is adjacent to said outer surface and a secondary portion of said cord remains adjacent to said inner surface;

(d)iv a second guide strap disposed on said inner surface positioned adjacent to a right back of said surrounding sidewall;

(d)v a third guide strap disposed on said inner surface positioned adjacent to a left back of said surrounding sidewall;

(d)vi a fourth guide strap disposed on said left sleeve inside surface adjacent to said left arm aperture;

(d)vii a fifth guide strap disposed on said left sleeve inside surface adjacent to said left arm aperture further positioned to be in line with said fourth guide strap to operationally position said adjustable strap against a left upper arm of the user to distribute the load from the skis on said adjustable strap in the least discomforting manner to the user; and (d)viii a sixth guide strap disposed on said inner surface positioned adjacent to a left hand front zipper of said surrounding sidewall, wherein said adjustable strap is disposed therethrough said second, third, fourth, fifth, and sixth guide straps, wherein said first, second, third, fourth, fifth, and sixth guide straps are positioned to locate said adjustable strap on the user upper torso to minimize a strap load on said strap being from a weight of the skis, specifically to load the user outer shoulder and not the user upper shoulder, wherein said cord first means for removable engagement is connected to said adjustable strap first strap end and said opposing second cord end with said second means for removable engagement is connected to said adjustable strap second strap end, wherein said first means for removable engagement facilitates said surrounding sidewall to be removably engageable as between said left and right hand front zippers of said surrounding sidewall, further said loop of said cord is looped around a ski toe binding assembly of a ski from the pair of skis to suspend the skis above the ground allowing the user to carry the skis via walking in a hands free manner.

5. A ski carrier apparatus for manually carrying skis according to claim 4 wherein said first and second semi rigid bendable "U" shaped planar sections are each sized and configured to selectably conform to and hold in a tight-fitting cup like manner around the edges of the skis to removably secure said flexible bracket to the skis.

6. A ski carrier apparatus for manually carrying skis according to claim 5 wherein said cord has a diameter that is no more than ten (10) percent of a width of said strap, to operationally facilitate said cord to fit under the ski toe binding assembly of the ski or a front foot binding of a snowboard, wherein said strap width is wider to increase a pressure loading area on the user upper torso to minimize fatigue and stress for the user from a strap load on said strap being from a weight of the skis.

7. A ski carrier apparatus for manually carrying skis according to claim 6 wherein said first and second reinforcement grommets defining said first and second apertures that are both disposed therethrough said torso surrounding sidewall respectively are all collectively replaced positionally by a slot disposed therethrough said torso surrounding sidewall, with said slot located as between said first and second apertures previous positions, wherein said primary portion of said cord forms said loop as between being disposed therethrough said slot, with said loop being positioned adjacent to said outer surface of said torso surrounding sidewall, further said loop of said cord is looped around the ski toe binding assembly of the ski from the pair of skis to suspend the skis above the ground allowing the user to carry the skis via walking in a hands free manner.

8. A ski carrier apparatus for manually carrying skis according to claim 7 wherein said slot further includes a fold over hook and loop fastener and an opposing fold under hook and loop fastener that are mated together to one another to close said slot onto itself to seal said torso surrounding sidewall around said primary portion of said cord formed in said loop.

9. A ski carrier apparatus for manually carrying skis according to claim 7 wherein said slot further includes an upper zipper teeth and an opposing lower zipper teeth and a zipper slider pull slidably engaged to both said upper and lower zipper teeth, wherein said zipper slider pull removably engages said upper and lower zipper teeth to close said slot onto itself to seal said torso surrounding sidewall around said primary portion of said cord formed in said loop.

10. A snowboard carrier apparatus for a user manually carrying the snowboard, said snowboard carrier apparatus comprising:

(a) an adjustable strap having a first strap end and an opposing second strap end, wherein operationally said strap is looped around an upper torso of a user;

(b) a cord having a first cord end with a first means for removable engagement to said adjustable strap first strap end and an opposing second cord end with a second means for removable engagement to said adjustable strap second strap end, wherein operationally said cord is adjacent to a lower torso of the user with the cord looped around a front foot binding of the snowboard to suspend the snowboard above the ground allowing the user to carry the snowboard via walking in a hands free manner;

(c) a jacket that includes a torso surrounding sidewall with an inner surface and an outer surface, also a left arm sleeve with a left arm aperture disposed therethrough said surrounding sidewall and a right arm sleeve with a right arm aperture disposed therethrough said surrounding sidewall, said left arm sleeve having a left sleeve inside surface and a left sleeve outside surface and said right arm sleeve having a right sleeve inside surface and a right sleeve outside surface;

(c)i a first reinforcement grommet defining a first aperture disposed therethrough said torso surrounding sidewall positioned adjacent to a right hand front zipper of said surrounding sidewall, wherein a primary portion of said cord is disposed therethrough said first reinforcement grommet;

(c)ii a second reinforcement grommet defining a second aperture therethrough said torso surrounding sidewall positioned adjacent to said right arm aperture, wherein said primary portion of said cord is also disposed therethrough said second reinforcement grommet, wherein said primary portion of said cord forms a loop as between said first and second reinforcement grommets, with said loop being positioned adjacent to said outer surface of said torso surrounding sidewall;

(c)iii a first guide strap disposed on said inner surface positioned adjacent to said second aperture, wherein said cord is disposed therethrough said first and second apertures and said first guide strap such that said primary portion of said cord between said first and second apertures is adjacent to said outer surface and a secondary portion of said cord remains adjacent to said inner surface;

(c)iv a second guide strap disposed on said inner surface positioned adjacent to a right back of said surrounding sidewall;

(c)v a third guide strap disposed on said inner surface positioned adjacent to a left back of said surrounding sidewall;

(c)vi a fourth guide strap disposed on said left sleeve inside surface adjacent to said left arm aperture;

(d)vii a fifth guide strap disposed on said left sleeve inside surface adjacent to said left arm aperture further positioned to be in line with said fourth guide strap to operationally position said adjustable strap against a left upper arm of the user to distribute the load from the snowboard on said adjustable strap in the least discomforting manner to the user; and (c)viii a sixth guide strap disposed on said inner surface positioned adjacent to a left hand front zipper of said surrounding sidewall, wherein said adjustable strap is disposed therethrough said second, third, fourth, fifth, and sixth guide straps, wherein said first, second, third, fourth, fifth, and sixth guide straps are positioned to locate said adjustable strap on the user upper torso to minimize a strap load on said strap being from a weight of the snowboard, specifically to load the user outer shoulder and not the user upper shoulder, wherein said cord first means for removable engagement is connected to said adjustable strap first strap end and said opposing second cord end with said second means for removable engagement is connected to said adjustable strap second strap end, wherein said first means for removable engagement facilitates said surrounding sidewall to be removably engageable as between said left and right hand front zippers of said surrounding sidewall, further said loop of said cord is looped around the front foot binding of the snowboard to suspend the snowboard above the ground allowing the user to carry the snowboard via walking in a hands free manner.

11. A snowboard carrier apparatus for manually carrying the snowboard according to claim 10 wherein said cord has a diameter that is no more than ten (10) percent of a width of said strap, to operationally facilitate said cord to fit under the front foot binding of the snowboard, wherein said strap width is wider to increase a pressure loading area on the upper torso to minimize fatigue and stress for the user from a strap load on said strap being from a weight of the snowboard.

12. A ski carrier apparatus for manually carrying skis according to claim 11 wherein said first and second reinforcement grommets defining said first and second apertures that are both disposed therethrough said torso surrounding sidewall respectively are all collectively replaced positionally by a slot disposed therethrough said torso surrounding sidewall, with said slot located as between said first and second apertures previous positions, wherein said primary portion of said cord forms said loop as between being disposed therethrough said slot, with said loop being positioned adjacent to said outer surface of said torso surrounding sidewall, further said loop of said cord is looped around the front foot binding of the snowboard to suspend the snowboard above the ground allowing the user to carry the snowboard via walking in a hands free manner.

13. A ski carrier apparatus for manually carrying skis according to claim 12 wherein said slot further includes a fold over hook and loop fastener and an opposing fold under hook and loop fastener that are mated together to one another to close said slot onto itself to seal said torso surrounding sidewall around said primary portion of said cord formed in said loop.

14. A ski carrier apparatus for manually carrying skis according to claim 12 wherein said slot further includes an upper zipper teeth and an opposing lower zipper teeth and a zipper slider pull slidably engaged to both said upper and lower zipper teeth, wherein said zipper slider pull removably engages said upper and lower zipper teeth to close said slot onto itself to seal said torso surrounding sidewall around said primary portion of said cord formed in said loop.

* * * * *